US011798468B2

(12) United States Patent
Cao et al.

(10) Patent No.: US 11,798,468 B2
(45) **Date of Patent: *Oct. 24, 2023**

(54) DISPLAY PANEL AND DISPLAY APPARATUS

(71) Applicant: Shanghai Tianma Micro-Electronics Co., Ltd., Shanghai (CN)

(72) Inventors: Zhaokeng Cao, Shanghai (CN); Gaojun Huang, Shanghai (CN); Zhongjie Zhang, Shanghai (CN); Chunmei Gao, Shanghai (CN); Yangzhao Ma, Wuhan (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/048,581

(22) Filed: Oct. 21, 2022

(65) Prior Publication Data

US 2023/0054978 A1 Feb. 23, 2023

Related U.S. Application Data

(63) Continuation of application No. 17/369,840, filed on Jul. 7, 2021, now Pat. No. 11,508,291.

(30) Foreign Application Priority Data

Apr. 27, 2021 (CN) ..... 202110462282.7

(51) Int. Cl.
*G09G 3/32* (2016.01)

(52) U.S. Cl.
CPC ..... *G09G 3/32* (2013.01); *G09G 2300/0426* (2013.01); *G09G 2300/0439* (2013.01);
(Continued)

(58) Field of Classification Search
CPC ..... G09G 3/32–3291; G09G 2300/0421–043; G09G 2300/0439;
(Continued)

(56) References Cited

U.S. PATENT DOCUMENTS 9,147,723 B1 9/2015 Lee et al.
2019/0130822 A1* 5/2019 Jung ..... G09G 3/3208
(Continued)

FOREIGN PATENT DOCUMENTS

CN 10534541 A 12/2019
CN 110610675 A 12/2019
(Continued)

OTHER PUBLICATIONS

Chinese Office Action dated Dec. 19, 2022, issued in related Japanese Application No. 202110462282.7 filed Apr. 27, 2021, 14 pages.

*Primary Examiner* — Nathan Danielsen
(74) *Attorney, Agent, or Firm* — CHRISTENSEN O'CONNOR JOHNSON KINDNESS PLLC

(57) ABSTRACT

A display panel and a display apparatus are provided. The display panel has a conventional display region and a function display region for arranging an optical function element, and includes first pixel circuits and first fixed potential lines that are located in the conventional display region and electrically connected to the first pixel circuits, and further includes second pixel circuits and second fixed potential lines that are located in the function display region and are electrically connected to the second pixel circuits. A distance between two adjacent first fixed potential lines of the first fixed potential lines is greater than a distance between two adjacent second fixed potential lines of the second fixed potential lines.

19 Claims, 12 Drawing Sheets

(52) U.S. Cl.
CPC ..... *G09G 2300/0842* (2013.01); *G09G 2320/0233* (2013.01); *G09G 2340/0407* (2013.01); *G09G 2340/145* (2013.01)

(58) Field of Classification Search
CPC ..... G09G 2300/0452–046; G09G 2300/0809; G09G 2300/0842; G09G 2300/0876; G09G 2310/0248; G09G 2310/0251; G09G 2310/06; G09G 2310/061; G09G 2310/08; G09G 2320/0233
See application file for complete search history.

(56) References Cited

U.S. PATENT DOCUMENTS

| | | | | |
|---|---|---|---|---|
| 2020/0098318 | A1* | 3/2020 | Liu | G09G 3/3291 |
| 2020/0126472 | A1 | 4/2020 | Tang et al. | |
| 2020/0265798 | A1* | 8/2020 | Choi | G09G 3/3233 |
| 2020/0410921 | A1* | 12/2020 | Kim | G09G 3/3233 |
| 2021/0013298 | A1 | 1/2021 | Her et al. | |
| 2021/0134242 | A1 | 5/2021 | Hei et al. | |
| 2021/0151483 | A1* | 5/2021 | Feng | G09G 3/3225 |
| 2021/0175298 | A1 | 6/2021 | Park | |

FOREIGN PATENT DOCUMENTS

| | | | |
|---|---|---|---|
| CN | 110767147 | A | 2/2020 |
| CN | 111405084 | A | 7/2020 |

* cited by examiner

DISPLAY PANEL AND DISPLAY APPARATUS

CROSS-REFERENCE TO RELATED DISCLOSURES

This application is a continuation of U.S. patent application Ser. No. 17/369,840, filed on Jul. 7, 2021, which claims priority to Chinese Patent Application No. 202110462282.7, filed on, Apr. 27, 2021. All of the above-mentioned patent applications are hereby incorporated by reference in their entireties.

TECHNICAL FIELD

This disclosure relates to the field of display technologies, and in particular, to a display panel and a display apparatus.

BACKGROUND

Full-screen display has gradually become the mainstream display technology with the increase in consumer demands. In the full-screen display in the related art, a transparent display region is usually provided in a display region, and an optical device is provided in the transparent display region. Because the transparent display region is not arranged in a non-display region, a bezel of a display screen becomes narrower, and the full-screen display can be achieved. At the same time, in order to improve visual experience, the transparent display region usually also has a display function. To improve the light transmittance of the transparent display region, a shading area of the transparent display region can be decreased as much as possible. However, in the design in the related art, a non-uniform display occurs while the shading area of the light transmission region is reduced. A problem to be resolved is to ensure that the transparent display region has both a good display effect and a relatively high light transmittance.

SUMMARY

According to a first aspect, an embodiment of this disclosure provides a display panel having a conventional display region and a function display region. The function display region is region where an optical function element is provided. The display panel includes first pixel circuits and first fixed potential lines that are located in the conventional display region, and second pixel circuits and second fixed potential lines that are located in the function display region. Each first fixed potential line extends along a first direction, and the first fixed potential lines are arranged along a second direction and are electrically connected to the first pixel circuits. Each second fixed potential line extends along a third direction, and the second fixed potential lines are arranged along a fourth direction and are electrically connected to the second pixel circuits. A distance between two adjacent first fixed potential lines of the first fixed potential lines is greater than a distance between two adjacent second fixed potential lines of the second fixed potential lines.

According to a second aspect, an embodiment of this disclosure provides a display apparatus, and the display apparatus includes the display panel according to the first aspect and the optical function element. The optical function element is provided at a position of the display apparatus corresponding to the function display region.

BRIEF DESCRIPTION OF THE DRAWINGS

To describe the technical solutions of the embodiments of the present disclosure more clearly, the following briefly describes the accompanying drawings required in the embodiments. The accompanying drawings in the following description show merely some examples of the present disclosure, and a person of ordinary skill in the art can still derive other drawings from these accompanying drawings.

DETAILED DESCRIPTION

Figure 1:
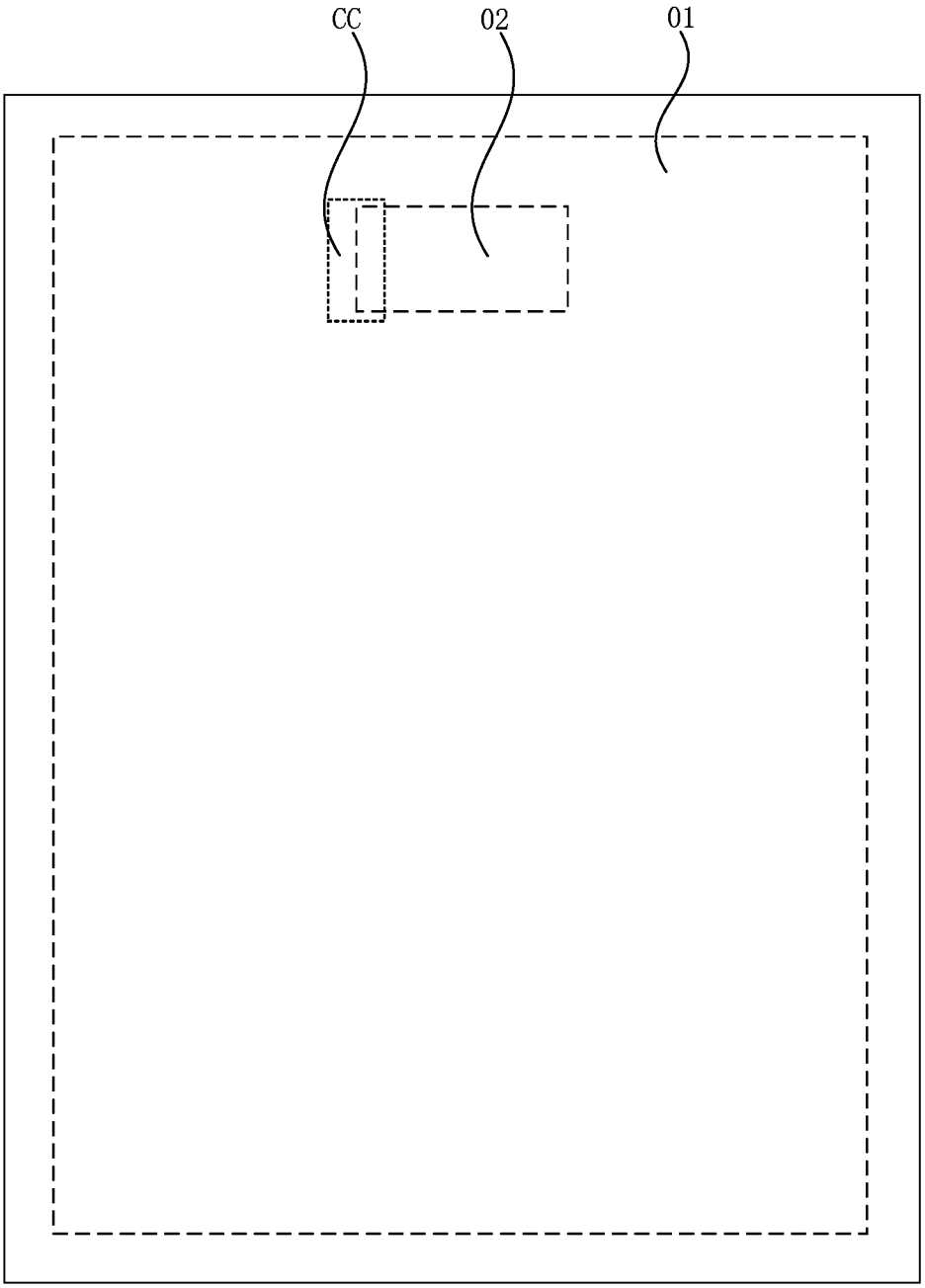
FIG. 1 is a schematic diagram of a display panel according to an embodiment of the present disclosure.

For better understanding of the technical solutions of the present disclosure, the following describes in detail the embodiments of the present disclosure with reference to the accompanying drawings.

It should be noted that, the described embodiments are merely some but not all of the embodiments of the present disclosure. All other embodiments obtained by a person of ordinary skill in the art based on the embodiments of the present disclosure shall fall within the protection scope of the present disclosure.

Terms used in the embodiments of the present disclosure are only for describing specific embodiments, and are not intended to limit this disclosure. Unless otherwise specified in the context, words such as "a", "the", and "said" in a singular form in the embodiments of the present disclosure and the appended claims include plural forms.

It should be understood that, the term "and/or" used in this specification describes only an association relationship of associated objects and represents that three relationships can exist. For example, A and/or B can represent the following three cases: A alone, both A and B, and B alone. In addition, the character "/" in this specification generally indicates an "or" relationship between the associated objects.

In the description of the present specification, it should be understood that the terms such as "substantially", "approximate to", "approximately", "about", "roughly", and "in general" described in the claims and embodiments of the present disclosure mean general agreement within a reasonable process operation range or tolerance range, rather than an exact value.

It should be understood that although the terms such as first, second, and third can be used to describe fixed potential lines in the embodiments of the present disclosure, these fixed potential lines should not be limited to these terms. These terms are used only to distinguish the fixed potential lines from each other. For example, without departing from the scope of the embodiments of the present disclosure, a first fixed potential line can also be referred to as a second fixed potential line, and similarly, a second fixed potential line can also be referred to as a first fixed potential line.

The solutions to the problem in the related art are provided in the following disclosure.

The display panels and display apparatuses with full-screen display effects in the related art are researched and analyzed, and it is found that there are at least the following three reasons of an obvious difference in display brightness between a transparent display region and a conventional display region. The reasons are illustrated in the following cases.

In a first case, an area of an anode serving as a reflective electrode in the transparent display region can be reduced. However, in order to ensure that the transparent display region has a relatively high display brightness, a relatively large light-emitting driving current can be provided for a light emitting diode in the transparent display region, which can cause serious degradation of the performance of the luminescent materials in the light emitting diode and further cause serious degradation in the brightness in the transparent display region. Therefore, a significant difference in display brightness between the transparent display region and the conventional display region can occur after the display panel and the display apparatus with related design are used for a period of time.

In a second case, a width of at least one signal line in the transparent display region can be reduced. However, a resistance of the at least one signal line increases as the width of the at least one signal line reduces, and thus there is a relatively large voltage drop on the at least one signal line when transmitting a signal, resulting in a non-uniform display brightness of the pixels in the transparent display region and a significant difference between the display brightness of the transparent display region and the display brightness of the conventional display region.

In a third case, an area of a storage capacitor in a pixel circuit in the transparent display region can be reduced, which leads to a situation that the storage capacitor cannot stably store a potential. In this way, some transistors in the pixel circuit generate leakage currents, resulting in unstable display of the pixel brightness in the transparent display region and a significant difference between the display brightness of the transparent display region and the display brightness of the conventional display region.

With the foregoing cases, a problem of the non-uniform display occurs while the light transmittance of the transparent display region is increased. In view of the foregoing problem, a research on reducing overall pixel density of the display panel is performed, so as to achieve display uniformity between the transparent display region and the conventional display region. In the embodiments provided in the present disclosure, the number of pixel circuit groups between adjacent specific fixed potential lines is changed, thereby increasing the light transmittance of the transparent display region (hereinafter referred to as a function display region) while causing a little impact on display uniformity.

The embodiments of the present disclosure provide a display panel and a display apparatus.

Figure 2:
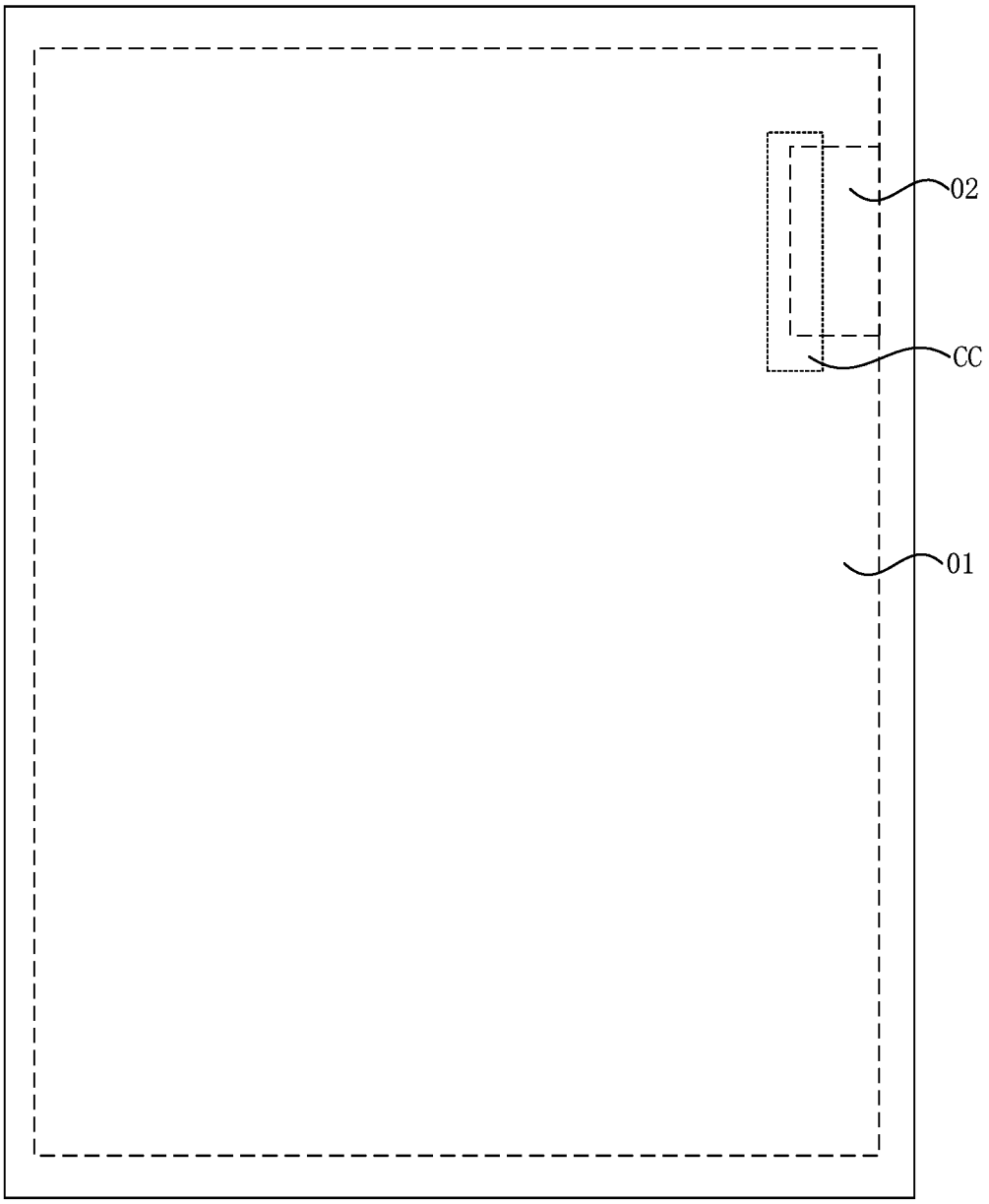
FIG. 2 is a schematic diagram of another display panel according to an embodiment of the present disclosure.
Figure 3:
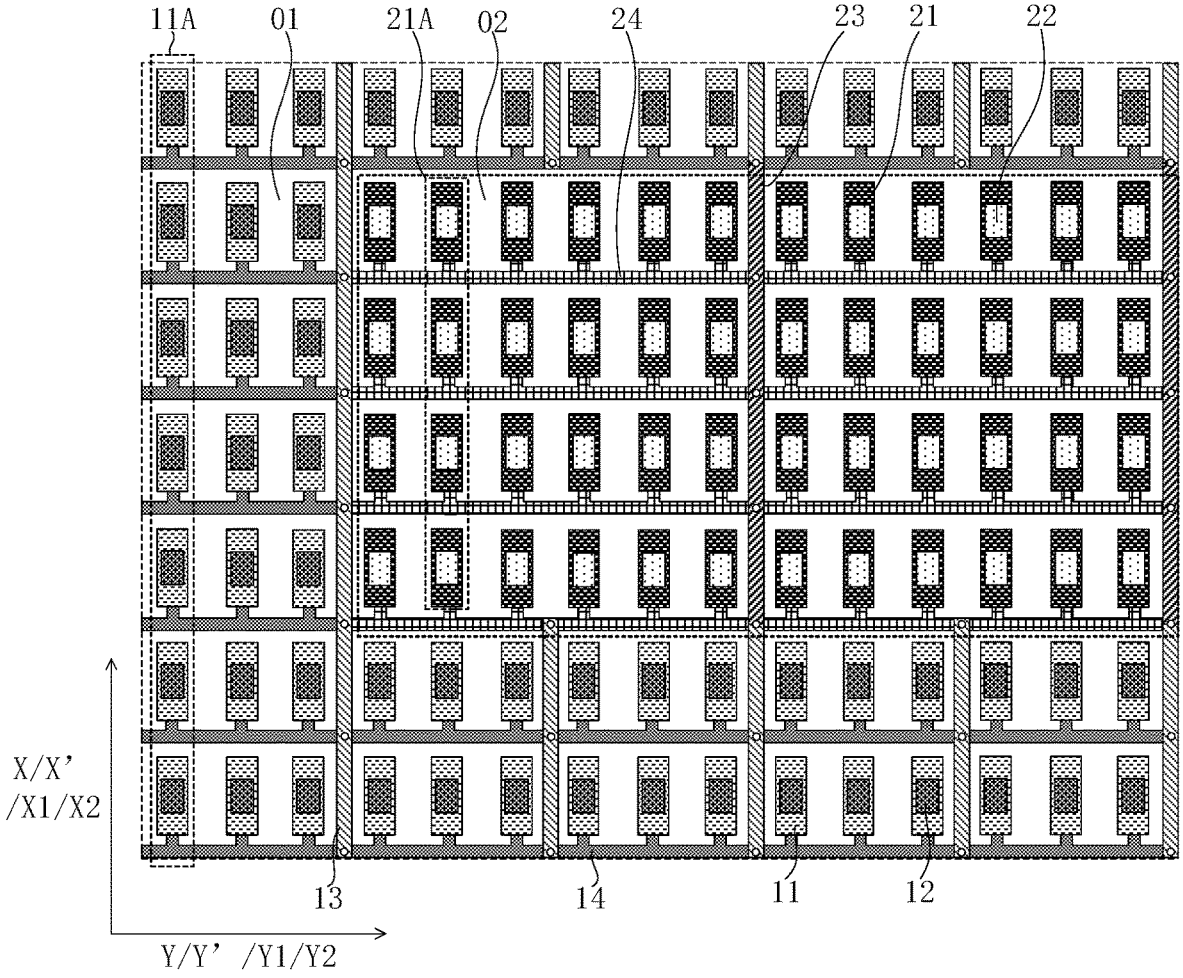
FIG. 3 is a partial enlarged view of a region CC in FIG. 1 and FIG. 2.

FIG. 1 is a schematic diagram of a display panel according to an embodiment of the present disclosure. FIG. 2 is a schematic diagram of another display panel according to an embodiment of the present disclosure. FIG. 3 is a partial enlarged view of a region CC in FIG. 1 and FIG. 2. The region CC is a region including a part of a conventional display region 01 and a part of a function display region 02.

As shown in FIG. 1 and FIG. 2, the display panel provided in this embodiment of the present disclosure includes the conventional display region 01 and the function display region 02. The function display region 02 is a region where an optical function element is arranged. In this case, the conventional display region 01 can perform light-emitting display, and in addition to implementing the light-emitting display function together with the conventional display region 01, the function display region 02 can also have an optical signal transmission function, such as at least one function of photographing, biometric identification, and illumination.

It should be noted that, the function display region 02 can be in a rectangular shape as shown in FIG. 1 and FIG. 2, or can be in other shapes such as an ellipse or a circle, which is not limited in the present disclosure.

Referring to FIG. 3, the display panel includes first pixel circuits 11, first light-emitting diodes 12, and first fixed potential lines 13, and the first pixel circuits 11. The first light-emitting diodes 12, and the first fixed potential lines 13 are located in the conventional display region 01. The first pixel circuit 11 is electrically connected to at least one first light-emitting diode 12. The first light-emitting diode 12 can be an organic light-emitting diode or a micro-light-emitting diode. The first pixel circuit 11 can provide the first light-emitting diode 12 with a light-emitting driving current to drive the first light-emitting diode 12 to emit light. The first fixed potential line 13 extends along a first direction X, and the first fixed potential lines 13 are arranged along a second direction Y. The first fixed potential line 13 is electrically connected to the first pixel circuit 11 and configured to provide the first pixel circuit 11 with a fixed potential signal.

Referring to FIG. 3, the display panel further includes second pixel circuits 21, second light-emitting diodes 22, and second fixed potential lines 23, and the second pixel circuits 21, the second light-emitting diodes 22, and the second fixed potential lines 23 are arranged in the function display region 02. The second pixel circuit 21 is electrically connected to at least one second light-emitting diode 22. The second light-emitting diode 22 can be an organic light-emitting diode or can be a micro-light-emitting diode. The second pixel circuit 21 can provide the second light-emitting diode 22 with a light-emitting driving current to drive the second light-emitting diode 22 to emit light. The second fixed potential line 23 extends along a third direction X', and the second fixed potential line 23 are arranged along a fourth direction Y'. The second fixed potential line 23 is electrically connected to the second pixel circuit 21 and configured to provide the second pixel circuit 21 with a fixed potential signal.

As shown in FIG. 3, m1 first pixel circuit groups 11A are provided between two adjacent first fixed potential lines 13 arranged along the second direction Y, and the first pixel circuit group 11A includes first pixel circuits 11 arranged along the first direction X; and m2 second pixel circuit groups 21A are provided between two adjacent second fixed potential lines 13' arranged along the third direction X', and the second pixel circuit group 21A includes second pixel circuits 21 arranged along the third direction X'.

In an embodiment of the present disclosure, m1 and m2 are each a positive integer greater than or equal to 1, and m2>m1. In other words, the number of the first pixel circuit groups 11A corresponding to one first fixed potential line 13 is less than the number of the second pixel circuit groups 21A corresponding to one second fixed potential line 23. For example, as shown in FIG. 3, three first pixel circuit groups 11A are arranged between two adjacent first fixed potential lines 13, and six second pixel circuit groups 21A are arranged between two adjacent second fixed potential lines 23.

In this embodiment of the present disclosure, the light transmittance of the function display region 02 can be improved by reducing the number of the second fixed potential lines 23 in the function display region 02, thereby improving reliability of optical signal transmission in the function display region 02.

There is a small impact on a display effect of the function display region 02 when reducing the number of second fixed potential lines 23. In an aspect, the second fixed potential line 23 transmits a fixed potential signal, and a substantially same attenuation of the fixed potential signal on the second fixed potential line 23 remains at different moments. Therefore, it is relatively easy to compensate the fixed potential signal on the second fixed potential line 23. In another aspect, the second fixed potential line 23 can be maintained to transmit the fixed potential signal within a period, without being frequently charged and discharged, thereby avoiding charging delay due to potential climbing (increasing) during a charging process. In still another aspect, compared with reducing the width of the second fixed potential line 23, reducing the density of the second fixed potential lines 23 does not change resistance and parasitic capacitance of the second fixed potential line 23, which has a relatively small impact on the display effect.

The first direction X can be parallel to the third direction X', and the second direction Y can be parallel to the fourth direction Y'.

In an embodiment of the present disclosure, referring to FIG. 1 and FIG. 2, the conventional display region 01 at least partially surrounds the function display region 02. For example, as shown in FIG. 1, the function display region 02 can be completely surrounded by the conventional display region 01. In an embodiment, as shown in FIG. 2, the function display region 02 can be partially surrounded by the conventional display region 01. In an embodiment, light transmittance of at least a part of the function display region 02 is greater than light transmittance of the conventional display region 01, which can ensure that a relatively large number of optical signals can pass through the function display region 02.

In an embodiment of the present disclosure, as shown in FIG. 3, a density of the first pixel circuits 11 in the conventional display region 01 is equal to a density of the second pixel circuits 21 in the function display region 02. In this way, an arrangement of the first pixel circuits 11 in the conventional display region 01 is the same as an arrangement of the second pixel circuits 21 in the function display region 02, which indicates that a composition of a repeated unit and a distance between the pixel circuits in the first pixel circuits 11 are the same as a composition of a repeated unit and a distance between the pixel circuits in the second pixel circuits 21, respectively.

In this embodiment, the light transmittance of the function display region 02 can be increased by reducing an area of the second pixel circuit 21 or by reducing shading traces in the function display region 02, and at the same time, a display resolution of the function display region 02 can be ensured.

Figure 4:
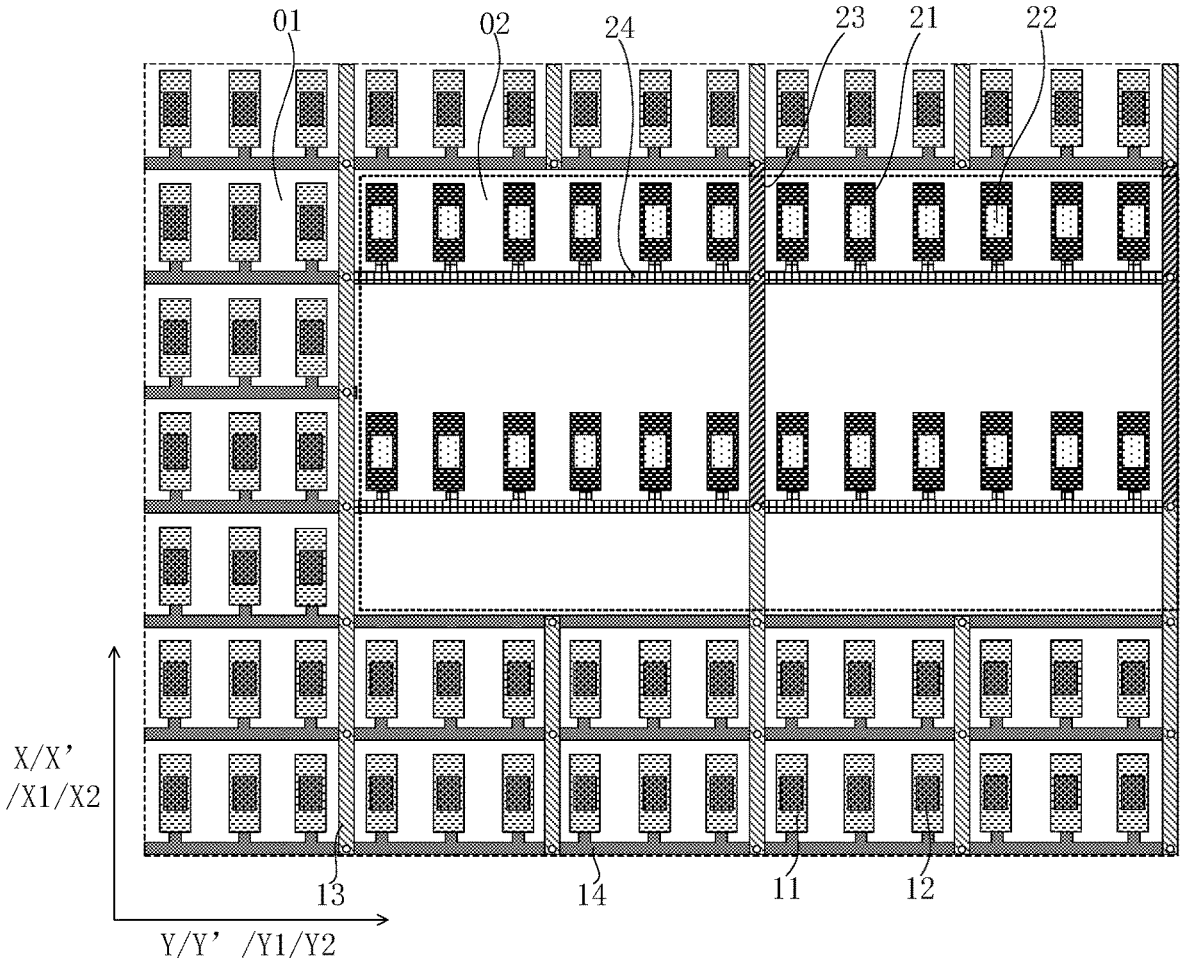
FIG. 4 is a partial enlarged view of a display panel according to an embodiment of the present disclosure.

FIG. 4 is a partial enlarged view of a display panel according to an embodiment of the present disclosure.

In another embodiment of the present disclosure, as shown in FIG. 4, the density of the first pixel circuits 11 in the conventional display region 01 is greater than the density of the second pixel circuits 21 in the function display region 02, and the second pixel circuits 21 are uniformly distributed in the function display region 02. In other words, the first pixel circuits 11 in the conventional display region 01 and the second pixel circuits 21 in the function display region 02 are all uniformly distributed, and the density of the second pixel circuits 21 in the function display region 02 is smaller than the density of the first pixel circuits 11.

In the foregoing embodiment, that the first pixel circuits 11 are uniformly distributed indicates that the first pixel circuits 11 are substantially uniformly distributed, and that the second pixel circuits 21 are uniformly distributed indicates that the second pixel circuits are substantially uniformly distributed. For example, a distance between two first pixel circuits 11 that are adjacent to the first fixed potential line 13 and that are arranged along the second direction Y is greater than a distance between two first pixel circuits 11 that are not adjacent to the first fixed potential line 13 and that are arranged along the second direction Y, and a distance between two second pixel circuits 21 that are adjacent to the second fixed potential line 23 and arranged along the second direction Y is greater than a distance between two second pixel circuits 21 that are not adjacent to the second fixed potential line 23 and that are arranged along the second direction Y. In this case, without taking the space occupied by the first fixed potential lines 13 and the second fixed potential lines 23 into consideration, the first pixel circuits 11 are substantially uniformly arranged and the second pixel circuits 21 are also substantially uniformly arranged.

In this embodiment, the light transmittance of the function display region 02 can be increased by setting the density of the second pixel circuits 21 in the function display region 02 to be relatively small.

Figure 5:
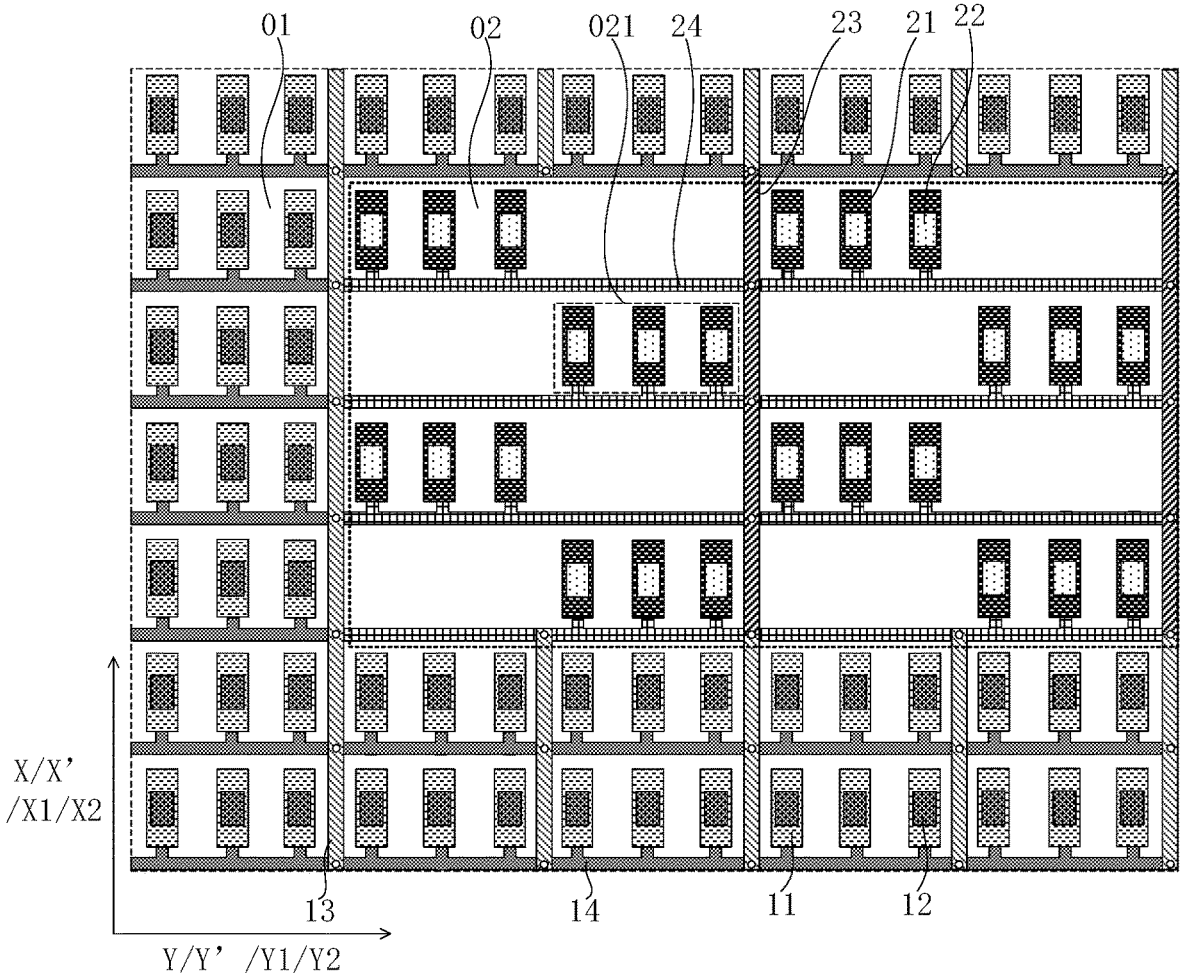
FIG. 5 is a partial enlarged view of another display panel according to an embodiment of the present disclosure.

FIG. 5 is a partial enlarged view of another display panel according to an embodiment of the present disclosure.

In still another embodiment of the present disclosure, as shown in FIG. 5, the density of the first pixel circuits 11 in the conventional display region 01 is greater than the density of the second pixel circuits 21 in the function display region 02, and at least two second pixel circuits 21 in the function display region 02 form a pixel circuit cluster 021, and a distance between adjacent second pixel circuits 21 in the pixel circuit cluster 021 is smaller than a distance between adjacent pixel circuit clusters 021. At least two second pixel circuits 21 in a same pixel circuit cluster 021 are electrically connected to a same second fixed potential line 23.

In an embodiment of the present disclosure, the second pixel circuits 21 in the function display region 02 are not uniformly distributed in a form of a single second pixel circuit 21, but can be uniformly distributed in a form of pixel circuit clusters 021. In an embodiment, that the density of the second pixel circuits 21 is smaller than the density of the first pixel circuits 11 can be understood as follows: if an area value corresponding to the function display region 02 is a first area, the number of the second pixel circuits 21 provided in the first area is smaller than the number of the first pixel circuits 11 provided in the first area.

For example, as shown in FIG. 5, in the function display region 02, a spacing distance between two adjacent pixel circuit clusters 021 arranged along the first direction X is greater than a width of the pixel circuit cluster 021 along the first direction X. In this case, as shown in FIG. 5, in the two adjacent pixel circuit clusters 021 arranged along the first direction X, a distance between a lower second pixel circuit 21 in an upper pixel circuit cluster 021 and an upper second pixel circuit 21 in a lower pixel circuit cluster 021 is greater than a width of one pixel circuit cluster 021. In the function display region 02, a spacing distance between two adjacent pixel circuit clusters 021 arranged along the second direction Y is greater than a width of the pixel circuit cluster 021 along the second direction Y. In this case, as shown in FIG. 5, in the two adjacent pixel circuit clusters 021 arranged along the second direction Y, a distance between a right second pixel circuit 21 in a left pixel circuit cluster 021 and a left second pixel circuit 21 in a right pixel circuit cluster 021 is greater than a width of one pixel circuit cluster 021.

In the conventional display region 01, in the first pixel circuits 11 arranged along the first direction X, spacing distances between adjacent first pixel circuits 11 are substantially the same, and in the first pixel circuits 11 arranged along the second direction Y, spacing distances between adjacent first pixel circuits 11 are also substantially the same. The term "substantially the same" indicates that without considering the space occupied by the first fixed potential lines 13 and the second fixed potential lines 23, the spacing distances between first pixel circuits 11 are substantially the same, and the spacing distance is significantly smaller than the width of the pixel circuit cluster 021.

In an embodiment, still referring to FIG. 5, to avoid a non-uniform display in the function display region 02, pixel circuit clusters 021 in the function display region 02 are arranged in a staggered manner, that is, the pixel circuit clusters 021 arranged along the second direction Y are arranged at intervals and a spacing blank region is arranged between adjacent pixel circuit clusters 021, and the pixel circuit clusters 021 arranged along the first direction X are also arranged at intervals and a spacing blank region is arranged between adjacent pixel circuit clusters 021. In the first direction X, the pixel circuit cluster 021 and the spacing blank region are arranged adjacent to each other. Because the pixel circuit clusters 021 are arranged in a staggered manner, the second pixel circuits 21 in the pixel circuit clusters 021 are also arranged in a staggered manner. For example, the pixel circuit cluster 021 includes three second pixel circuits 21 respectively providing a red sub-pixel, a green sub-pixel, and a blue sub-pixel with light-emitting driving currents. In this case, the second pixel circuits 21 respectively providing red sub-pixels with light-emitting driving currents are arranged in a staggered manner, the second pixel circuits 21 respectively providing green sub-pixels with light-emitting driving currents are arranged in a staggered manner, and the second pixel circuits 21 respectively providing blue sub-pixels with light-emitting driving currents are also arranged in a staggered manner.

In the conventional display region 01, the first pixel circuits 11 are arranged in a matrix, that is, the first pixel circuits 11 are arranged in sequence along the first direction X and the first pixel circuits 11 are arranged in sequence along the second direction Y. In this case, the first pixel circuits 11 respectively providing red sub-pixels with light-emitting driving currents are arranged in a matrix, the first pixel circuits 11 respectively providing green sub-pixels with light-emitting driving currents are arranged in a matrix, and the first pixel circuits 11 respectively providing blue sub-pixels with light-emitting driving currents are also arranged in a matrix.

In an embodiment, a distance between two adjacent second fixed potential lines 23 are increased, which can reduce an impact of a diffraction phenomenon on the optical signal collection in the function display region 02. According to the principle of proximity, a distance between each second fixed potential line 23 and the second pixel circuit 21 carried by the second fixed potential line 23 does not increase, but the light transmittance of the function display region 01 increases.

In an embodiment, at least two second pixel circuits 21 in the pixel circuit cluster 021 are electrically connected to the second light-emitting diodes 12 emitting light of at least two colors, respectively. In this case, it can be ensured that the function display region 01 has a better white balance effect while the function display region 02 has a larger light transmittance by reducing the density of second pixel circuits 21.

In an embodiment, if pixel circuit clusters 021 arranged along the first direction X are regarded as one pixel circuit cluster group, as shown in FIG. 5, although the pixel circuit cluster groups between two adjacent second fixed potential lines 23 are increased to two pixel circuit cluster groups, because the pixel circuit clusters 021 are arranged in a staggered manner, the pixel circuit clusters 021 carried by each second fixed potential line 23 are not increased. In this embodiment, because the second pixel circuits 21 carried by the second fixed potential line 34 are not increased, a load current of the second fixed potential line 23 is not increased, which ensures that the second pixel circuit 21 can obtain a stable fixed potential signal.

Figure 6:
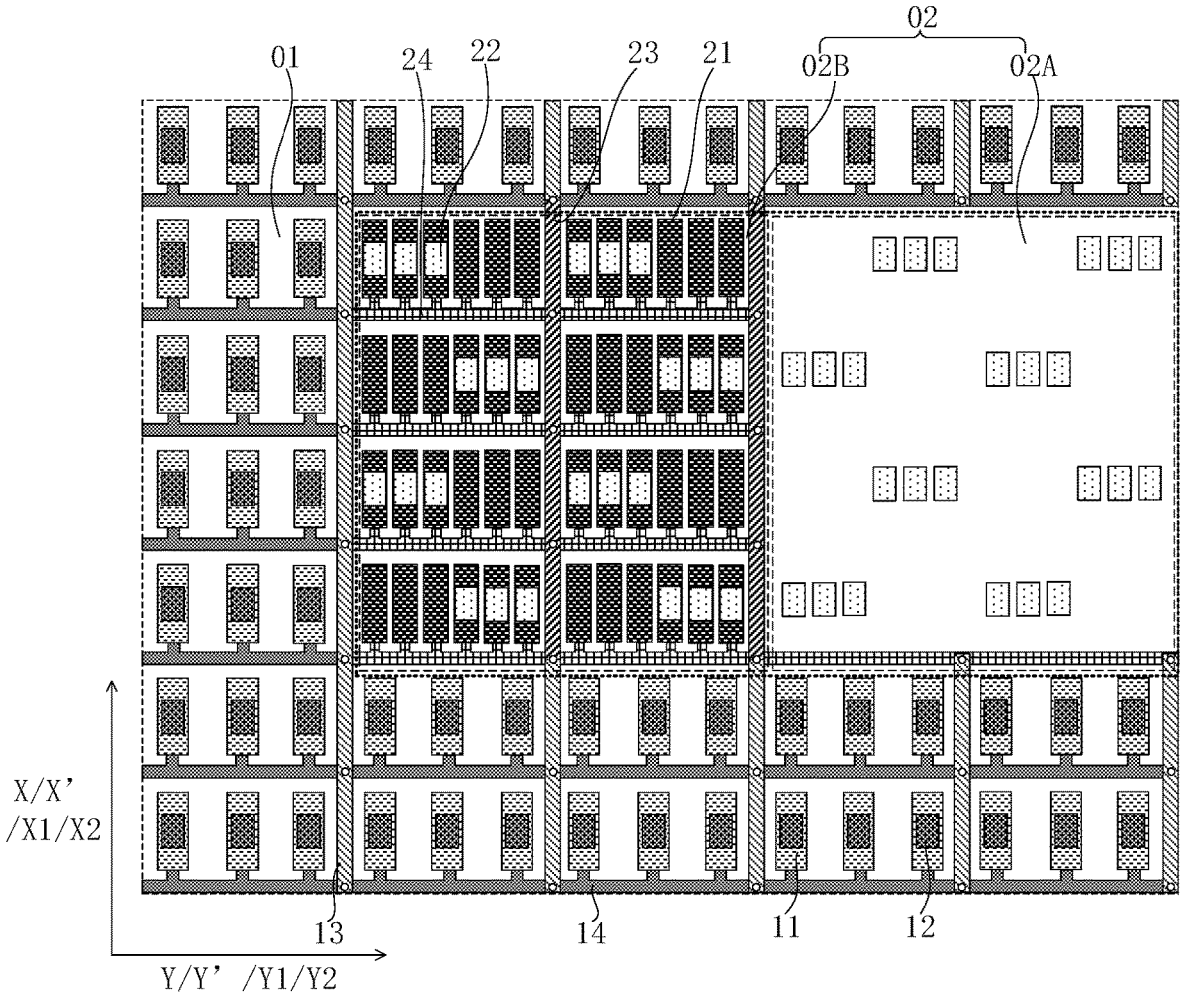
FIG. 6 is a partial enlarged view of still another display panel according to an embodiment of the present disclosure.

FIG. 6 is a partial enlarged view of still another display panel according to an embodiment of the present disclosure.

In yet another embodiment of the present disclosure, as shown in FIG. 6, the function display region 02 includes a transparent display region 02A and a transition display region 02B. The transition display region 02B is located between the conventional display region 01 and the transparent display region 01A. Second light-emitting diodes 22 are provided in the transparent display region 02A and the transition display region 02B. However, the second pixel circuits 21 in the function display region 02 are provided in the transition display region 02B. In other words, the second pixel circuits 21 electrically connected to the second light-emitting diodes 22 in the transparent display region 02A are provided in the transition display region 02B. As shown in FIG. 6, some second pixel circuits 21 located in the transition display region 02B are electrically connected to the second light-emitting diodes 22 located in the transition display region 02B to provide light-emitting driving currents to the second light-emitting diodes 22 located in the transition display region 02B. Some other second pixel circuits 21 are electrically connected to the second light-emitting diodes 22 located in the transparent display region 02A and provide light-emitting driving currents to the second light-emitting diodes 22 located in the transparent display region 02A.

FIG. 6 shows that the second light-emitting diodes 22 located in the transition display region 02B overlap the second pixel circuits 21 that are electrically connected to the second light-emitting diodes 22 located in the transition display region 02B, but the second light-emitting diodes 22 in the transition display region 02B cannot overlap the second pixel circuits 21 electrically connected to the second light-emitting diodes 22 in the transition display region 02B, provided that they are electrically connected to each other. For example, the second light-emitting diodes 22 can be uniformly distributed in the transition display region 02B, and a density of the second light-emitting diodes 22 in the transition display region 02B can be the same as a density of first light-emitting diodes 12 in the conventional display region 01.

In an embodiment, the density of the second pixel circuits 21 located in the transition display region 02B is greater than a density of first pixel circuits 11 located in the conventional display region 01, and a distance between adjacent first fixed potential lines 13 is equal to a distance between adjacent second fixed potential lines 23.

For example, as shown in FIG. 6, the density of the second pixel circuits 21 located in the transition display region 02B is substantially twice the density of the second light-emitting diodes 22 located in the transition display region 02B, the second pixel circuits 21 in the transition display region 02B are uniformly distributed in a matrix, and the first pixel circuits 11 in the conventional display region 01 are also uniformly distributed in a matrix. In this case, in the second direction Y, the density of the second pixel circuits 21 in the transition display region 02B is twice the density of the first pixel circuits 11 in the conventional display region 01. In this case, the distance between two adjacent second fixed potential lines 23 can be equal to the distance between two adjacent first fixed potential lines 13, and the number of columns of the second pixel circuits 21 between two adjacent second fixed potential line 23 is twice the number of columns of the first pixel circuits 11 between two adjacent first fixed potential lines 13.

In an embodiment, still referring to FIG. 6, along a thickness direction of the display panel, the second fixed potential lines 23 do not overlap the transparent display region 02A, that is, no second fixed potential line 23 is arranged in the transparent display region 02A.

In this embodiment, none of the second pixel circuit 21 or related signal lines are provided in the transparent display region 02A, which achieves a better light transmittance of the transparent display region 02A. In an embodiment, the density of the second fixed potential signal lines 23 in the transition display region 02B is the same as the density of the first fixed potential lines 13 in the conventional display region 01. In a macro view, resistance of a fixed potential line providing the pixel circuit with the fixed potential signal is uniformly distributed without increasing local resistance, so that a voltage drop difference on the fixed potential line at different positions can be avoided to a particular extent, thereby improving the display uniformity of the display panel.

In the foregoing embodiment, the fact that the first pixel circuits 11 are uniformly distributed indicates that the first pixel circuits 11 are substantially uniformly distributed, and that the second pixel circuits 21 are uniformly distributed indicates that the second pixel circuits are substantially uniformly distributed. For example, a distance between two first pixel circuits 11 adjacent to the first fixed potential line 13 and arranged along the second direction Y is greater than a distance between two first pixel circuits 11 that are not adjacent to the first fixed potential line 13 and that are arranged along the second direction Y, and a distance between two second pixel circuits 21 adjacent to the second fixed potential line 23 and arranged along the second direction Y is greater than a distance between two second pixel circuits 21 that are not adjacent to the second fixed potential line 23 and that are arranged along the second direction Y. In this case, without considering the space occupied by the first fixed potential lines 13 and the second fixed potential lines 23, the first pixel circuits 11 are substantially uniformly arranged and the second pixel circuits 21 are also substantially uniformly arranged.

In an embodiment of the present disclosure, as shown in FIG. 3 to FIG. 6, the first direction X is parallel to the third direction X', the second direction Y is parallel to the fourth direction Y', and the first direction X is perpendicular to the second direction Y. In other words, the first fixed potential lines 13 are parallel to the second fixed potential lines 23, and the first fixed potential lines 13 are arranged in a same direction as the second fixed potential lines 23.

In an embodiment, as shown in FIG. 3 to FIG. 6, the second fixed potential line 23 is aligned with one first fixed potential line 13 in the second direction Y, and the second fixed potential line 23 is connected to the first fixed potential line 13. It can be understood that the second fixed potentials line 23 and the first fixed potential line 11 aligned with and connected to the second fixed potentials line 23 are different parts of a same potential line respectively located in the function display region 02 and the conventional display region 01.

Figure 7:
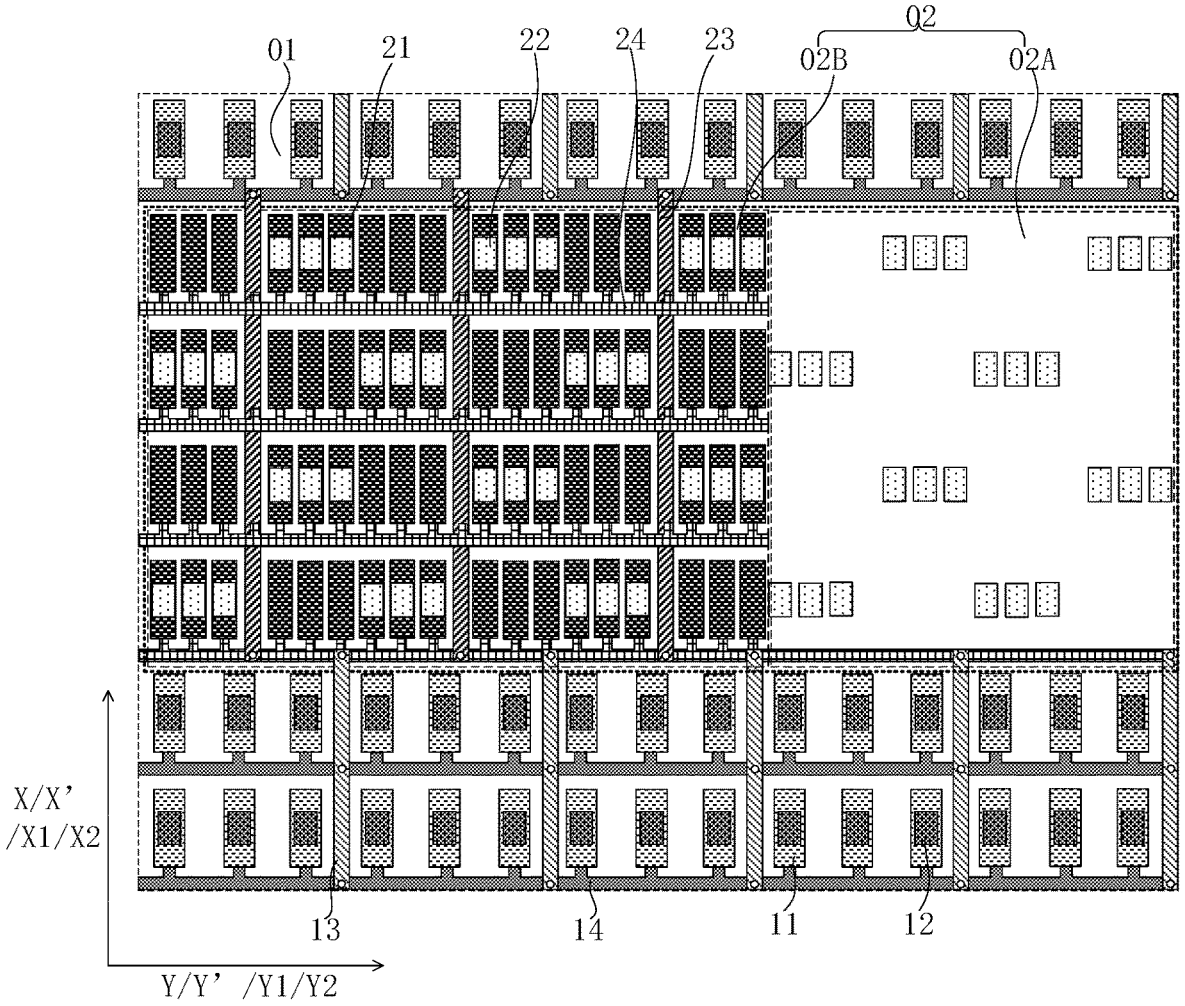
FIG. 7 is a partial enlarged view of yet another display panel according to an embodiment of the present disclosure.
Figure 8:
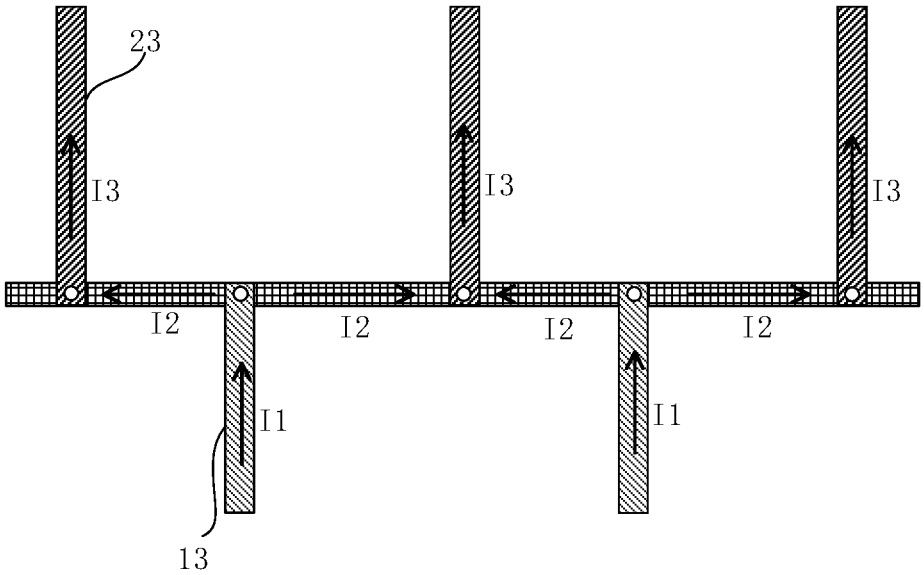
FIG. 8 is a schematic current diagram of the display panel shown in FIG. 7.

FIG. 7 is a partial enlarged view of yet another display panel according to an embodiment of the present disclosure. FIG. 8 is a schematic current diagram of the display panel shown in FIG. 7.

In another embodiment, as shown in FIG. 7, the second fixed potential line 23 is staggered with any first fixed potential line 13 in the second direction Y. It can be understood that the second fixed potential line 23 and the first fixed potential line 11 are fixed potential lines that are respectively located in the function display region 02 and the conventional display region 01 and are not continuous along the second direction Y.

With reference to FIG. 7 and FIG. 8, when the second fixed potential line 23 and the first fixed potential line 13 are not continuous along the second direction Y, that is, being staggered with each other, a current I1 transmitted by the first fixed potential line 13 is transmitted along the second direction Y, and when the current I1 flows to the second fixed potential line 23, a current I2 flowing in a direction crossing the second direction Y is derived. In this case, a current arriving at the second fixed potential line 23 changes to a current I3, and I3<I1. In another embodiment, when a current I3 transmitted by the second fixed line 23 is transmitted along the second direction Y and flows to the first fixed potential line 13, the current changes to a current I1, and I1<I3. In other words, it is equivalent to dispersing a voltage drop on the first fixed potential line 23 and a voltage drop on the second fixed potential line 13 to a part connecting the second fixed potential line 23 and the first fixed potential line 13 that are connected in a staggered manner, which can improve the display uniformity by dispersing the voltage drop.

In an embodiment, the first fixed potential line 13 and the second fixed potential line 23 are adjacent to a blue sub-pixel. A luminescent material used for the blue sub-pixel in the related art is a fluorescent luminescent material with a relatively low efficiency. Therefore, to ensure light-emitting brightness of the blue sub-pixel, a voltage difference between a fixed potential signal and a data voltage signal in each of the first pixel circuit 11 and the second pixel circuit 21 that correspond to the blue sub-pixel is the largest. The fixed potential signal lines are disposed near the blue sub-pixel, which can minimize a non-uniform display of the blue sub-pixel.

In an embodiment, the first fixed potential line 13 and the second fixed potential line 23 are provided between the blue sub-pixel and the green sub-pixel. Because the green sub-pixel contributes the most to the display brightness, the non-uniform display of the green sub-pixel is the most easily visible. Therefore, the first fixed potential line 13 and the second fixed potential line 23 are adjacent to the green sub-pixel, which can improve the display uniformity of a white image or other high-brightness image.

Figure 9:
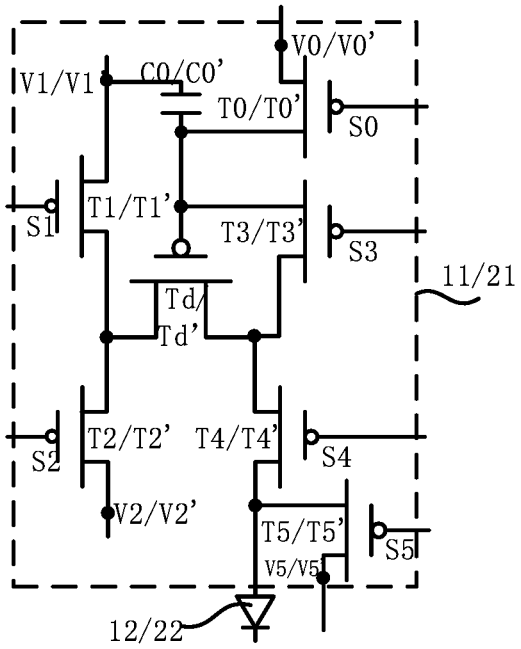
FIG. 9 is an equivalent circuit diagram of a first pixel circuit and a second pixel circuit in a display panel according to an embodiment of the present disclosure.

FIG. 9 is an equivalent circuit diagram of a first pixel circuit and a second pixel circuit in a display panel according to an embodiment of the present disclosure.

In an embodiment, as shown in FIG. 9, the first pixel circuit 11 includes a first drive transistor Td, and the first drive transistor Td is configured to generate a light-emitting driving current for driving the first light-emitting diode 12 to emit light; and the second pixel circuit 21 includes a second drive transistor Td', and the second drive transistor Td' is configured to generate a light-emitting driving current for driving the second light-emitting diode 22 to emit light.

In an embodiment, referring to FIG. 9, the first pixel circuit 11 further includes at least one first reset transistor, a control terminal of the first drive transistor Td and/or an anode of the first light-emitting diode 12 is electrically connected to an output terminal of the first reset transistor; and the second pixel circuit 21 further includes at least one second reset transistor T0', a control terminal of the second drive transistor Td' and/or an anode of the second light-emitting diode 22 is electrically connected to an output terminal of the second reset transistor T0'.

In an embodiment of the present disclosure, the first pixel circuit 11 includes two first reset transistors T0 and T5, an output terminal of the first reset transistor T0 is electrically connected to the control terminal of the first drive transistor Td, and an input terminal V0 of the first reset transistor T0 receives a reset signal and transmits the reset signal to the control terminal of the first drive transistor Td, to reset the control terminal of the first drive transistor Td; and an output terminal of the first reset transistor T5 is electrically connected to the anode of the first light-emitting diode 12, and an input terminal V5 of the first reset transistor T5 receives a reset signal and transmits the reset signal to the anode of the first light-emitting diode 12, to reset the anode of the first light-emitting diode 12.

In another embodiment of the present disclosure, the second pixel circuit 21 includes two second reset transistors T0' and T5', an output terminal of the second reset transistor T0' is electrically connected to the control terminal of the second drive transistor Td', and an input terminal V0' of the second reset transistor T0' receives a reset signal and transmits the reset signal to the control terminal of the first drive transistor Td, to reset the control terminal of the second drive transistor Td'; an output terminal of the second reset transistor T5' is electrically connected to the anode of the second light-emitting diode 22, and an input terminal V5' of the second reset transistor T0' receives a reset signal and transmits the reset signal to the anode of the second light-emitting diode 22, to reset the anode of the second light-emitting diode 22.

In an embodiment of the present disclosure, still referring to FIG. 9, the first pixel circuit 11 further includes a first power voltage transistor T1, and an output terminal of the first power voltage transistor T1 is electrically connected to the first drive transistor Td. In an embodiment, the output terminal of the first power voltage transistor T1 can be electrically connected to an input terminal of the first drive transistor Td, and the input terminal V1 of the first power voltage transistor T1 receives a supply voltage and transmits the supply voltage to the first drive transistor T1; and the second pixel circuit 21 includes a second power voltage transistor T1', and an output terminal of the second power voltage transistor T1' is electrically connected to the second drive transistor Td'. In an embodiment, the output terminal of the second power voltage transistor T1' can be electrically connected to an input terminal of the second drive transistor Td', and an input terminal V1' of the second power voltage transistor T1' receives a supply voltage signal an transmits the supply voltage signal to the second drive transistor Td'.

The first pixel circuit 11 and the second pixel circuit 21 can be of a same circuit structure. As shown in FIG. 9, the first pixel circuit 11 can include a first drive transistor Td, a first reset transistor T0/T5, a first power voltage transistor T1, a first data voltage writing transistor T2, a first threshold capturing transistor T3, a first light-emitting control transistor T4, and a first storage capacitor C; and the second pixel circuit 21 can include a second drive transistor Td', a second reset transistor T0'/T5', a second power voltage transistor T1', a second data voltage writing transistor T2', a second threshold capturing transistor T3', a second light-emitting control transistor T4', and a second storage capacitor C'. In addition, an input terminal V2' of the second data voltage writing transistor T2' can be connected to a same type of signal line as an input terminal V1 of the first data voltage writing transistor T1.

In another embodiment, the first pixel circuit 11 and the second pixel circuit 21 can have different circuit structures. The following describes an operating process of the first pixel circuit 11 by taking the first pixel circuit 11 shown in FIG. 9 as an example.

In an example, the first drive transistor Td, the first reset transistor T0/T5, the first power voltage transistor T1, the first data voltage writing transistor T2, the first threshold capturing transistor T3, and the first light-emitting control transistor T4 in the first pixel circuit 11 shown in FIG. 9 are all P-type transistors. In other embodiment, the first drive transistor Td, the first reset transistor T0/T5, the first power voltage transistor T1, the first data voltage writing transistor T2, the first threshold capturing transistor T3, and the first light-emitting control transistor T4 can all be N-type transistors, or some of them can be P-type transistors and others can be N-type transistors.

An output terminal of one first reset transistor T0 is electrically connected to a control terminal of the first drive transistor Td. An output terminal of another first reset transistor T5 is electrically connected to the anode of the first light-emitting diode 12. The output terminal of the first power voltage transistor T1 is electrically connected to the input terminal of the first drive transistor Td, the input terminal V1 of the first power voltage transistor T1 is electrically connected to one plate of the first storage capacitor C, and the control terminal of the first drive transistor Td is electrically connected to the other plate of the first storage capacitor C. An input terminal V2 of the first data voltage writing transistor T2 receives a data voltage, and an output terminal of the first data voltage writing transistor T2 is electrically connected to the input terminal of the first drive transistor Td. An input terminal of the first threshold capturing transistor T3 is electrically connected to an output terminal of the first drive transistor Td, and an output terminal of the first threshold capturing transistor T3 is electrically connected to the control terminal of the first drive transistor Td. An input terminal of the first light-emitting control transistor T4 is electrically connected to the output terminal of the first drive transistor Td, and an output terminal of the first light-emitting control transistor T4 is electrically connected to the first light-emitting diode 12.

The operating process of the first pixel circuit 11 shown in FIG. 9 can include a reset phase, a data voltage writing phase, and a light-emitting phase.

In the reset phase, if the first reset transistor T0 is turned on under control of the control terminal S0 of the first reset transistor T0, and the input terminal V0 of the first reset transistor T0 receives a reset signal, the reset signal is written to the control terminal of the first drive transistor Td. In other embodiments, if the first reset transistor T5 is turned on under control of a control terminal S5 of the first reset transistor T5, and the input terminal V5 of the first reset transistor T5 receives a reset signal, the reset signal is also written to the anode of the first light-emitting diode 12.

In the data voltage writing phase, the first power voltage transistor T1 is turned off under control of a control terminal S1 of the first power voltage transistor T1, and the first light-emitting control transistor T4 is turned off under control of a control terminal S4 of the first light-emitting control transistor T4. The first data voltage writing transistor T2 is turned on under control of a control terminal S2 of the first data voltage writing transistor T2, and the first threshold capturing transistor T3 is turned on under control of a control terminal S3 of the first threshold capturing transistor T3. The input terminal V2 of the first data voltage writing transistor T2 receives a data voltage Vdata. Because potential of the data voltage Vdata is higher than that of a reset signal stored in the first storage capacitor C, the first drive transistor Td is turned on and the data voltage Vdata is written to the control terminal of the first drive transistor Td. When a voltage of the control terminal of the first drive transistor Td is Vdata-|Vth|, the first drive transistor Td is turned off, and the first storage capacitor C can store potential Vdata-|Vth| electrically connected to the control terminal of the first drive transistor Td at the end of the data voltage writing phase. In addition, in another embodiment of the present disclosure, in the reset phase, the control terminal S5 of the first reset transistor T5 receives a cut-off signal. In the data voltage writing phase, the control terminal S5 of the first reset transistor T5 receives a turn-on signal to control the first reset transistor T5 to be turned on, and the input terminal V5 of the first reset transistor T5 receives a reset signal. In this case, the anode of the first light-emitting diode 12 is also reset in the data voltage writing phase.

In the light-emitting phase, the first data voltage writing transistor T2 is turned off under control of the control terminal S2 of the first data voltage writing transistor T2, the first threshold capturing transistor T3 is turned off under control of the control terminal S3 of the first threshold capturing transistor T3, the first power voltage transistor T1 is turned on under control of the control terminal S1 of the first power voltage transistor T1, and the first light-emitting control transistor T4 is turned on under control of the control terminal S4 of the first light-emitting control transistor T4. The input terminal V1 of the first power voltage transistor T1 receives a supply voltage VDD. In this case, the supply voltage is transmitted to the input terminal of the light-emitting driving transistor Td. Potential of the supply voltage VDD is greater than that of the data voltage Vdata. In this case, the first drive transistor Td generates a light-emitting driving current, and transmits the light-emitting driving current to the first light-emitting diode 12 through the first light-emitting control transistor T4. In this case, the light-emitting driving current generated by the first drive transistor Td is: Ids=K*(VDD−Vdata)^2.

FIG. 9 shows an equivalent circuit diagram of the first pixel circuit 11 and the second pixel circuit. Specific structures of the first pixel circuit 11 and the second pixel circuit 21 can be in other forms.

In an embodiment of the present disclosure, the input terminal V0 of the first reset transistor T0 is electrically connected to the first fixed potential line 13, that is, a fixed potential signal received by the first fixed potential line 13 can be a reset signal, and the first fixed potential line 13 can provide a reset signal for the input terminal V0 of the first reset transistor T0. The input terminal V0' of the second reset transistor T0' is electrically connected to the second fixed potential line 23, that is, a fixed potential signal received by the second fixed potential line 23 can be a reset signal, and the second fixed potential line 23 can provide a reset signal for the input terminal V0' of the second reset transistor T0'.

In this embodiment, when the number of the second pixel circuit groups 21A between adjacent second fixed potential lines 23 in the function display region 02 is greater than the number of the first pixel circuit groups 11A between adjacent first fixed potential lines 13 in the conventional display region 02, it is equivalent to a decrease in the number of the second fixed potential lines 23 connected in parallel and an increase in resistance of the corresponding second fixed potential lines 23 connected in parallel. However, because the second fixed potential line 23 transmits a fixed potential signal as a reset signal, the increase in the resistance of the second fixed potential lines 23 connected in parallel does not significantly affect the light-emitting driving current generated by the second pixel circuit 21. Details are described below.

In one aspect, because a voltage drop of the fixed potential signal serving as a reset signal is very low, an increase in resistance of the second fixed potential lines 23 connected in parallel has almost no impact on a process of resetting the first reset transistors T0 in the second pixel circuit 21.

A micro-element method is used herein for analysis. According to a formula ΔV=I*R for calculating a voltage drop, the voltage drop on the second fixed potential line 23 depends on a current flowing through the second fixed potential line 23 and a resistance of the second fixed potential line 23, where ΔV is the voltage drop of the second fixed potential line 23, I is the current flowing through the second fixed potential line 23, and R is the resistance of the second fixed potential line 23.

Resetting the control terminal of the first drive transistor Td and the control terminal of the second drive transistor Td' is actually respectively charging the first storage capacitor electrically connected to the control terminal of the first drive transistor Td and charging the second storage capacitor C' electrically connected to the control terminal of the second drive transistor Td'. The embodiments shown in FIG. 3 and FIG. 4, FIG. 6 and FIG. 7, and FIG. 14 are used as examples for description. It is equivalent that one first fixed potential line 13 in the conventional display region 01 charges the first storage capacitors C in three first pixel circuit groups 11A, and one second fixed potential line 23 in the function display region 02 charges the second storage capacitors C' in six second pixel circuit groups 21A. Capacitance of the first storage capacitor C and capacitance of the second storage capacitor C' are very small and resistance of the second fixed potential line 23 is very small. Therefore, compared with the conventional display region 01, although in the function display region 02, the voltage drop on the second fixed potential line 23 increases, a voltage drop difference between the first fixed potential line 13 and the second fixed potential line 23 is almost negligible.

For example, an organic light-emitting display panel is used as an example for description. The capacitance of the first storage capacitor C and that of the second storage capacitor C' are both in the order of magnitude of pF and a time of the reset phase is in the order of magnitude of μs, and for the potential of the control terminal of the first drive transistor Td and the potential of the control terminal of the second drive transistor Td', a voltage difference between a data voltage of a previous frame and a reset signal voltage of a current frame falls within 10 V. Therefore, it can be obtained through calculation that a current for charging the control terminal of the first drive transistor Td and the control terminal of the second drive transistor Td' in the reset phase is in the order of magnitude of μA. The first fixed potential line 13 and the second fixed potential line 23 that transmit the reset signals are usually made of Ti/Al/Ti, and each has sheet resistance in the order of magnitude of $10^{-2}\Omega/\square$. Therefore, both a voltage drop difference of the first fixed potential lines 13 and a voltage drop difference of the second fixed potential lines 23 are of the order of magnitude of $10^{-2}$ μV and is almost negligible. Even if the first fixed potential line 13 and the second fixed potential line 23 that transmit the reset signals are made of Mo, the sheet resistance of the first fixed potential line 13 and that of the second fixed potential line 23 are in the order of magnitude of $10^{-1}\Omega/\square$. Therefore, the voltage drop difference of the first fixed potential lines 13 and the voltage drop difference of the second fixed potential lines 23 are in the order of magnitude of $10^{-1}$ μV and is also negligible. In addition, in the organic light-emitting display panel, the fixed potential signal as a reset signal is usually about −2 V. A ratio of each of the voltage drop difference of the first fixed potential lines 13 in the reset phase and the voltage drop difference of the second fixed potential lines 23 in the reset phase to a voltage value of the reset signal is so small that the ratio is negligible.

When the anode of the first light-emitting diode 12 and the anode of the second light-emitting diode 22 also can be reset, in order to reduce the current flowing through the second fixed potential line 23, in an embodiment, the process of resetting the control terminal of the first drive transistor Td and the control terminal of the second drive transistor Td' and the process of resetting the anode of the first light-emitting diode 12 and the anode of the second light-emitting diode 22 can be performed in a time-division manner. For example, the process of resetting the control terminal of the first drive transistor Td and the control terminal of the second drive transistor Td' is performed in the reset phase, and the process of resetting the anode of the first light-emitting diode 12 and the anode of the second light-emitting diode 22 is performed in the data voltage writing phase. In this case, even if the voltage drop difference on the first fixed potential line 13 and the second fixed potential line 23 is relatively large when the anode of the first light-emitting diode 12 and the anode of the second light-emitting diode 22 are reset, potential of each terminal of each of the first drive transistor Td and the second drive transistor Td' for generating a light-emitting driving current is not affected.

In another aspect, the fixed potential signal serving as a reset signal does not directly affect generation of the light-emitting driving current and therefore has little impact on the light-emitting driving current. That is, a change of the fixed potential signal transmitted by the second fixed potential line 23 has little impact on the light-emitting driving current generated by the second light-emitting diode 22.

First, in a non-pure-color screen, a potential difference between control terminals of all second drive transistors Td' in the previous frame is quite large, and the voltage drop on the second fixed potential line 23 is negligible compared with the potential difference. In a pure-color screen, target data voltages of sub-pixels of a same color are the same, and potential of a reset signal of the control terminal of the second drive transistor Td' at this time affects generation of the light-emitting driving current. However, charging the second storage capacitor C' in the reset phase is a process that is fast at first and then slow. A longer charging time indicates that potential of the control terminal of the second drive transistor Td' is closer to that of the reset signal. Impact of the time for charging the second storage capacitor C' in the reset phase on the potential of the control terminal of the second drive transistor Td' is much greater than that of the voltage drop of the second fixed potential line 23 on the potential of the control terminal of the second drive transistor Td'.

Second, in the data voltage writing phase, different reset signals of the control terminal of the first drive transistor Td and the control terminal of the second drive transistor Td' cause different data voltages actually input into the control terminal of the first drive transistor Td and the control terminal of the second drive transistor Td'. However, impact of different threshold voltages of the first drive transistors Td in the first pixel circuit 11 and different threshold voltages of the second drive transistors Td' in the second pixel circuit 21 on the difference in light-emitting driving currents is much greater than impact of the voltage drop of the second fixed potential line 23 on the difference in light-emitting driving currents.

In still another aspect, the first fixed potential line 13 and the second fixed potential line 23 each transmit a fixed potential signal as a reset signal, and the transmitted reset signal serves as a fixed potential signal instead of a pulse signal. Therefore, the first fixed potential line 13 and the second fixed potential line 23 do not need to be charged and discharged frequently, which can reduce impact of the number of first fixed potential lines 13 and the number of second fixed potential lines 23 on the load carried by the first fixed potential line 13 and the load carried the second fixed potential line 23, respectively. Reducing the number of second fixed potential lines 23 is equivalent to reducing parasitic capacitance of the second fixed potential lines 23 in the function display region 02. Therefore, even if the load carried by a single second fixed potential line 23 is increased, the total load carried by all the second fixed potential lines 23 is not increased. Therefore, there is little impact on the light-emitting driving current.

Therefore, based on the above, when the first fixed potential line 13 and the second fixed potential line 23 of the present disclosure transmit the fixed potential signals, an area of a non-transmissive part of the function display region 02 can be reduced, causing little impact on the display brightness while increasing the light transmittance of the function display region 02, thereby ensuring display uniformity of the function display region 02 and uniformity of display brightness of the function display region 02 and the conventional display region 01. In other words, both a display effect and light transmittance are considered for the display panel with the function display region 02 provided in this disclosure, thereby overcoming the difficulty in restricting the under-screen optical sensor technology.

Technical solution provides the display panel in which the density of the pixels in the function display region 02 is substantially to the same as the density of the pixel in the conventional display region 01. When the density of the pixels in the function display region 02 is substantially to the same as the density of the pixel in the conventional display region 01 in the display panel, in order to achieve a normal display function, data signal lines and scan signals cannot be reduced. In addition, narrowing the data voltage signal lines and the scanning lines affects parasitic capacitance on the scanning lines and the data voltage signal lines, and causes a line charging effect to deteriorate. Consequently, the data voltage signals deviate from a target value, and the scanning lines charge the first pixel circuit 11 and the second pixel circuit 21 without enough time. It can be deduced from the foregoing analysis that reducing the number of second fixed potential lines 23 that transmit reset signals has a little impact on the display uniformity. Therefore, reducing the number of second fixed potential lines 23 that transmit reset signals is crucial in achieving the ultimate goal of not reducing resolution of the function display region 02.

In an embodiment of the present disclosure, the function display region 02 is arranged at a position away from an access terminal of the fixed potential signal, that is, a distance between the function display region 02 and the access terminal of the fixed potential signal is greater than a distance between the function display region 02 and a side of the conventional display region 01 away from the access terminal of the fixed potential signal.

Since the fixed potential signal, serving as the reset signal, enters the conventional display region 01 and the function display region 02 of the display panel from the access terminal of the fixed potential signal, along an extending direction of the first fixed potential line 13, a current of the first fixed potential line 13, in a unit length, close to the access terminal of the fixed potential signal is greater than a current of the first fixed potential line 13, in a unit length, far away from the access terminal of the fixed potential signal; and along an extending direction of the second fixed potential line 23, a current of the second fixed potential line, in a unit length, close to the access terminal of the fixed potential signal is greater than a current of the second fixed potential line 23, in a unit length, far away from the access terminal of the fixed potential signal. In other words, along the extending direction of the first fixed potential line 13, a voltage drop of the first fixed potential line 13 at a position thereof far away from the access terminal of the fixed potential signal is less than a voltage drop of the first fixed potential line 13 at a position thereof close to the access terminal of the fixed potential signal; and along the extending direction of the second fixed potential line 23, a voltage drop of the second fixed potential line 23 at a position thereof far away from the access terminal of the fixed potential signal is less than a voltage drop of the second fixed potential line 23 at a position thereof close to the access terminal of the fixed potential signal. Therefore, setting the function display region 02 to be far away from the access terminal of the fixed potential signal can reduce a difference between a voltage drop of the second fixed potential line in the function display region 02 and a voltage drop of the first fixed potential line 13 in the adjacent conventional display region 01.

Similarly, if the access terminals of the fixed potential signal are located on two opposite sides of the display panel, the function display region 02 can be arranged at a middle position of the two opposite sides of the display panel.

In an embodiment, $(m2/m1)*H \leq 200$, where H denotes the total number of rows of the second pixel circuits 21 arranged along the first direction X in the function display region 02. According to the description of the foregoing embodiments, a voltage drop difference of the second fixed potential line 23 is usually in the order of a magnitude of $10^{-2}$ μV. When the design of the second fixed potential lines 23 in the function display region 02 and the design of the first fixed potential lines 13 in the conventional display region 01 satisfy the foregoing relationship, two rows of the second pixel circuits 21 in the function display region 01 that receive reset signals with a largest difference are also in the order of the magnitude of μV, which is still imperceptible to the naked eyes. Similarly, a difference between a voltage drop of the first fixed potential signal line 13 in a region adjacent to the function display region 02 in the conventional display region 01 and a voltage drop of the second fixed potential signal 23 in the function display region 02 is also very small. Therefore, the brightness difference between the function display region 02 and the conventional display region 01 is also imperceptible to naked eyes of consumers.

In an embodiment, the function display region 02 is disposed at a side of the conventional display region 01 away from the access terminal of the fixed potential signal. In this case, an edge of the function display region 02 away from the access terminal of the fixed potential signal is also away from the conventional display region 01, that is, edges of the function display region 02 are not all adjacent to the conventional display region 01, thereby reducing a length of a risk region in which the brightness can suddenly change in the conventional display region 01 and the function display region 02 that are adjacent to each other.

In an embodiment, as shown in FIG. 3 to FIG. 7, the display panel further includes third fixed potential lines 14 arranged in the conventional display region 01, the third fixed potential line 14 extends along a fifth direction Y1, and the third fixed potential lines 14 are arranged along a sixth direction X1 and electrically connected to at least two first fixed potential lines 13. In an embodiment, the display panel further includes fourth fixed potential lines 24 disposed in the function display region 02, the fourth fixed potential line 24 extends along a seventh direction Y2, and the fourth fixed potential lines 24 are arranged along an eighth direction X2 and electrically connected to at least two second fixed potential lines 23.

The fifth direction Y1 and the seventh direction Y2 can be parallel to the second direction Y and the fourth direction Y', and the sixth direction X1 and the eighth direction X2 can be parallel to the first direction X and the second direction X'. In other words, the third fixed potential line 14 and the fourth fixed potential line 24 are also configured to transmit reset signals. In addition, the first fixed potential line 13 and the third fixed potential line 14 intersect and are electrically connected to each other to form a mesh structure, and the second fixed potential line 23 and the fourth fixed potential line 24 intersect and are electrically connected to each other to form a mesh structure.

With reference to the FIG. 8, in a case where the first fixed potential line 13 and the third fixed potential line 14 intersect and are electrically connected to each other to form the mesh structure, and the second fixed potential line 23 and the fourth fixed potential line 24 intersect and are electrically connected to each other to form a mesh structure, a current transmitted on the second fixed potential line 23 and the first fixed potential line 13 is dispersed to the third fixed potential line 14 and the fourth fixed potential line 24, so that the current on the first fixed potential line 13 and the second fixed potential line 23 is relatively reduced, and a voltage drop on the first fixed potential line 13 and a voltage drop on the second fixed potential line 23 are reduced. In this way, the dispersion of the voltage drop can improve display uniformity.

In an embodiment, the first fixed potential line 13 and the second fixed potential line 23 are each of a metal conductive structure, and the third fixed potential line 14 and the fourth fixed potential line 24 are each of a semiconductor conductive structure.

Figure 10:
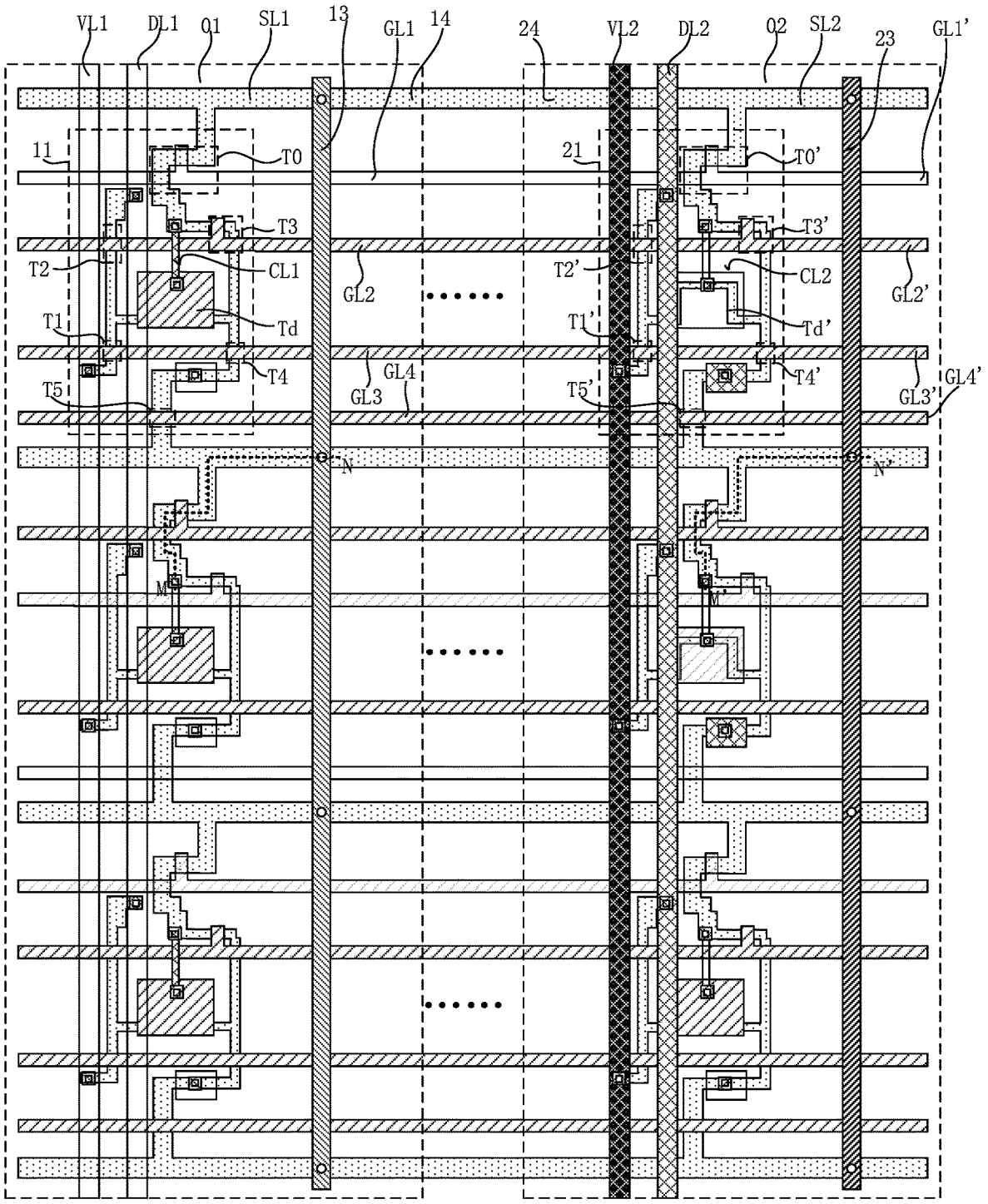
FIG. 10 is a schematic diagram of an actual structure and layout of the pixel circuits shown in FIG. 9.
Figure 11:
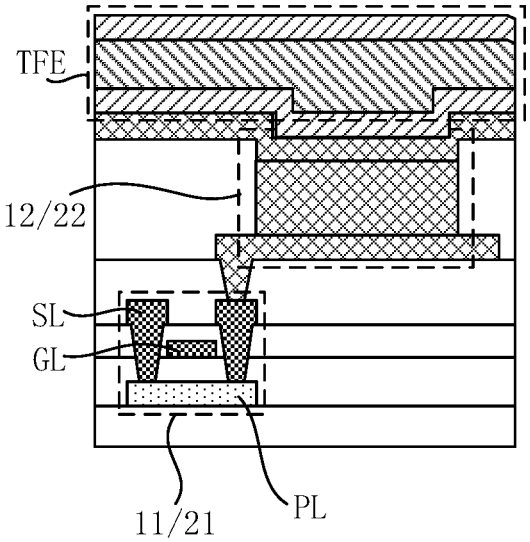
FIG. 11 is a partial schematic cross-sectional view of FIG. 10.
Figure 12:
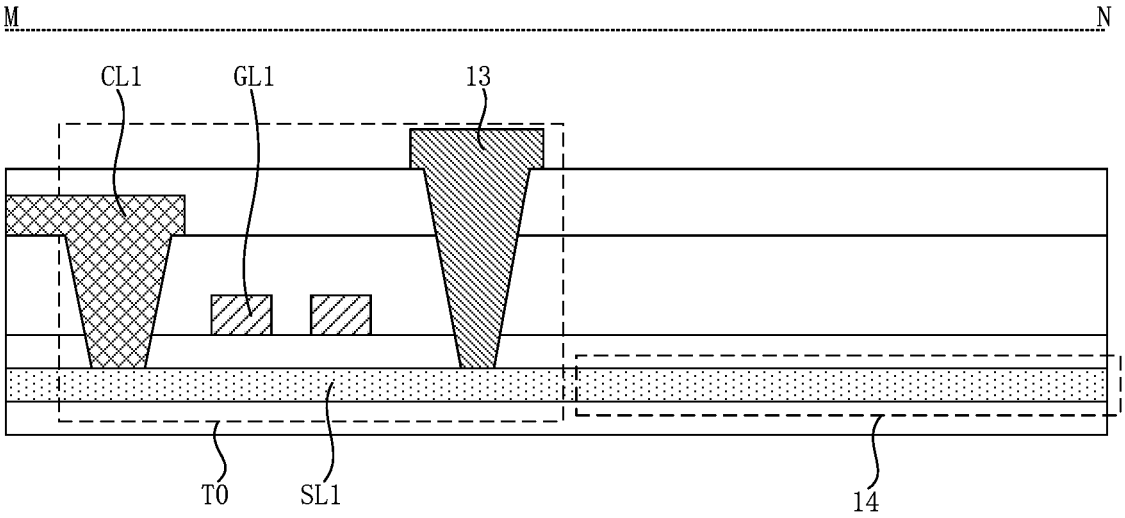
FIG. 12 is a cross-sectional view along a direction MN in FIG. 10.
Figure 13:
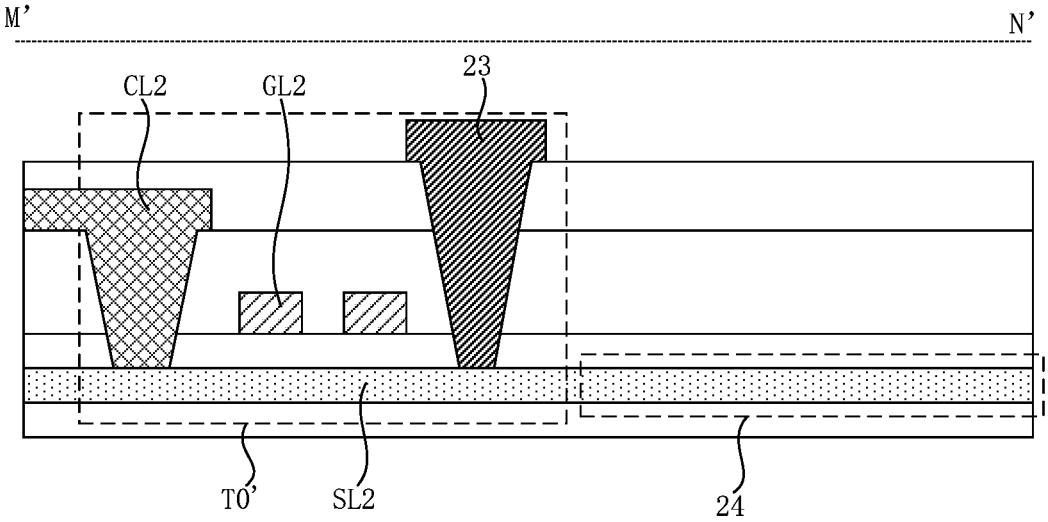
FIG. 13 is a cross-sectional view along a direction M'N' in FIG. 10.

FIG. 10 is a schematic diagram of an actual structure and layout of the pixel circuits shown in FIG. 9. FIG. 11 is a partial schematic cross-sectional view of FIG. 10. FIG. 12 is a cross-sectional view along a direction MN in FIG. 10. FIG. 13 is a schematic cross-sectional view along a direction M'N' in FIG. 10. It should be noted that, to avoid vagueness of the accompanying drawing caused by superposition of layers, the structures of the first storage capacitor C and the second storage capacitor C' are not shown in FIG. 10.

With reference to FIG. 10 and FIG. 11, transistors in the first pixel circuit 11 and the second pixel circuit 12 each include a semiconductor layer PL, a gate GL, a source SL, and a drain. The semiconductor layer PL of the transistor is provided on a substrate. A gate insulation layer is provided between the gate GL and the semiconductor layer PL. An inter-layer insulation layer is provided between the source SL and the gate GL. A planarization layer is provided between the anode and the source SL. A pixel defining layer is provided on the anode. An organic light-emitting layer is provided in an opening of the pixel defining layer. The first light-emitting diode 12 and the second light-emitting diode 22 are electrically connected to the first pixel circuit 11 and the second pixel circuit 21, respectively. When the first light-emitting diode 12 and the second light-emitting diode 22 are organic light-emitting diodes, the first light-emitting diode 12 and the second light-emitting diode 22 each include an anode, a cathode, and an organic light-emitting layer located between the anode and the cathode, In an embodiment, an encapsulation layer TFE is further provided on a side of each of the first light-emitting diode 12 and the second light-emitting diode 22 close to a light-emitting surface. Some organic light-emitting display panels can further include a capacitor metal layer provided between a layer where the gate GL is located and a layer where the source SL is located, a first inter-layer insulation layer provided between the capacitor metal layer and the layer where the gate GL is located, and a second inter-layer insulation layer provided between the capacitor metal layer and the layer where the source SL is located.

With reference to FIG. 10 and FIG. 12, the first reset transistor T0 in the first pixel circuit 11 can include a first semiconductor structure SL1, a first gate, a first source, and a first drain. The first gate, as a control terminal, is electrically connected to and is located in a same layer as the scanning line GL1, the first source, as an input terminal, is electrically connected to the first fixed potential line 13, and the first drain, as an output terminal, is electrically connected to a connection line CL1 electrically connected to the control terminal of the first drive transistor Td.

Still referring to FIG. 10, each transistor in the first pixel circuit 11 includes a first semiconductor structure (a semiconductor layer PL), and first semiconductor structures (semiconductor layers PL) of the transistors are connected together. For example, the first semiconductor structure of the first drive transistor Td in the first pixel circuit 11, the first semiconductor structure of the first reset transistor T0, the first semiconductor structure of the first power voltage transistor T1, the first semiconductor structure of the first data voltage writing transistor T2, the first semiconductor structure of the first threshold capturing transistor T3, and the first semiconductor structure of the first light-emitting control transistor T4 are connected together.

Still referring to FIG. 10, first semiconductor structures in adjacent first pixel circuits 11 can also be connected together, for example, by being connected together through the third fixed potential line 14. First semiconductor structures in first pixel circuits 11 arranged along the second direction Y are located in a same layer as and are provided continuously with the adjacent third fixed potential line 14, and first semiconductor structures in first pixel circuits 11 located at two sides of the third fixed potential line 14 are all located in a same layer as and are provided continuously with the third fixed potential line 14.

Still with reference to FIG. 10 and FIG. 12, the third fixed potential line 14 and the first fixed potential line 13 are connected to each other through a via hole. In this case, the first fixed potential line 13 can receive the reset signal and transmit the reset signal to the first pixel circuit 11 through the third fixed potential line.

With reference to FIG. 10 and FIG. 13, the second reset transistor T0' in the second pixel circuit 21 can include a second semiconductor structure SL2, a second gate, a second source, and a second drain. The second gate, as a control terminal, is electrically connected to the scanning line GL2, the second source, as an input terminal, is electrically connected to the second fixed potential line 23, the second drain, as an output terminal, is electrically connected to a connection line CL2 electrically connected to the control terminal of the second drive transistor Td'.

Still referring to FIG. 10, each transistor in the second pixel circuit 21 can include a second semiconductor structure (a semiconductor layer PL), and second semiconductor structures (semiconductor layers PL) of the transistors are connected together. For example, the second semiconductor structure of the second drive transistor Td' in the second pixel circuit 21, the second semiconductor structure of the second reset transistor T0', the second semiconductor structure of the second power voltage transistor T1', the second semiconductor structure of the second data voltage writing transistor T2', the second semiconductor structure of the second threshold capturing transistor T3', and the second semiconductor structure of the second light-emitting control transistor T4' are connected together.

Still referring to FIG. 10, the second semiconductor structures in adjacent second pixel circuits 21 are also connected together, for example, being connected through the fourth fixed potential line 24. Second semiconductor structures in second pixel circuits 21 arranged along the fourth direction Y' are located in a same layer as and are provided continuously with the adjacent fourth fixed potential line 24, and the second semiconductor structures in the second pixel circuits 21 located at two sides of the fourth fixed potential line 24 are all located in a same layer as and are provided continuously with the fourth fixed potential line 24.

Still with reference to FIG. 10 and FIG. 13, the fourth fixed potential line 24 and the second fixed potential line 23 can be connected through a via hole. In this case, the second fixed potential line 23 can receive the reset signal and transmit the reset signal to the second pixel circuit 21 through the fourth fixed potential line.

Still referring to FIG. 10, the third fixed potential line 14 and the fourth fixed potential line 24 are each a continuous semiconductor structure, but are located in the conventional display region 01 and the function display region, respectively. In this case, the first semiconductor structure in the first pixel circuit 11 and the second semiconductor structure in the second pixel circuit 21 can also be connected together.

In an embodiment, gates of the transistors with a same function or transistors that are turned on and off at the same time in the first pixel circuits 11 arranged along the second direction Y can be connected to a same scanning line. For example, the first gates of the first reset transistors T0 in the first pixel circuits 11 arranged along the second direction Y can be connected to a same scanning line GL1; control terminals S2 of the first data voltage writing transistors T2 and control terminals S3 of the first threshold capturing transistors T3 in the first pixel circuits 11 arranged along the second direction Y can be connected to a same scanning line GL2; control terminals S1 of the first power voltage transistors T1 and control terminals S4 of the first light-emitting control transistors T4 in the first pixel circuits 11 arranged along the second direction Y can be connected to a same scanning line GL3; and control terminals S5 of the first reset transistors T5 in the first pixel circuits 11 arranged along the second direction Y can be connected to a same scanning line GL4, and the scanning line GL4 can be reused as a scanning line GL1 in a next row.

Gates of transistors with a same function or transistors that are turned on and off at the same time in the second pixel circuits 21 arranged along the fourth direction Y' can be connected to a same scanning line. For example, second gates of the second reset transistors T0' in the second pixel circuits 21 arranged along the fourth direction Y' can be connected to a same scanning line GL1'; control terminals of the second data voltage writing transistors T2' and control terminals of second threshold capturing transistors T3' in the second pixel circuits 21 arranged along the fourth direction Y' can be connected to a same scanning line GL2'; control terminals of the second power voltage transistors T1' and control terminals of the second light-emitting control transistors T4' in the second pixel circuits 21 arranged along the fourth direction Y' can be connected to a same scanning line GL3; and control terminals S5 of the second reset transistors T5' in the second pixel circuits 21 arranged along the fourth direction Y' can be connected to a same scanning line GL4', and the scanning line GL4' can be reused as a scanning line GL1' in a next row.

When the second direction Y is parallel to the fourth direction Y', gates of the transistors with a same function or transistors that are turned on and off at the same time in the first pixel circuits 11 arranged along the second direction Y and the plurality of second pixel circuits 21 can be connected to a same scanning line. For example, the scanning line GL1 connected to the first gates of the first reset transistors T0 in the first pixel circuits 11 arranged along the second direction Y is the scanning line GL1' connected to the second gates of the second reset transistors T0' in the second pixel circuits 21. Similarly, the scanning line GL2 and the scanning line GL2' that are located in a same row are a same scanning line, the scanning line GL3 and the scanning line GL3' that are located in a same row are a same scanning line, and the scanning line GL4 and the scanning line GL4' that are located in a same row are a same scanning line.

Input terminals V2 of the first data voltage writing transistors T2 in the first pixel circuits 11 arranged along the first direction X can be connected to a same data voltage signal line DL1, and input terminals V2' of the second data voltage writing transistors T2' in the second pixel circuits 21 arranged along the third direction X' can be connected to a same data voltage signal line DL2. Input terminals V1 of the first power voltage transistors T1 in the plurality of first pixel circuits 11 arranged along the first direction X can be connected to a same power voltage signal line VL1, and input terminals V1' of the first power voltage transistors T1' in the second pixel circuits 21 arranged along the third direction X' can be connected to a same power voltage signal line VL2.

Figure 14:
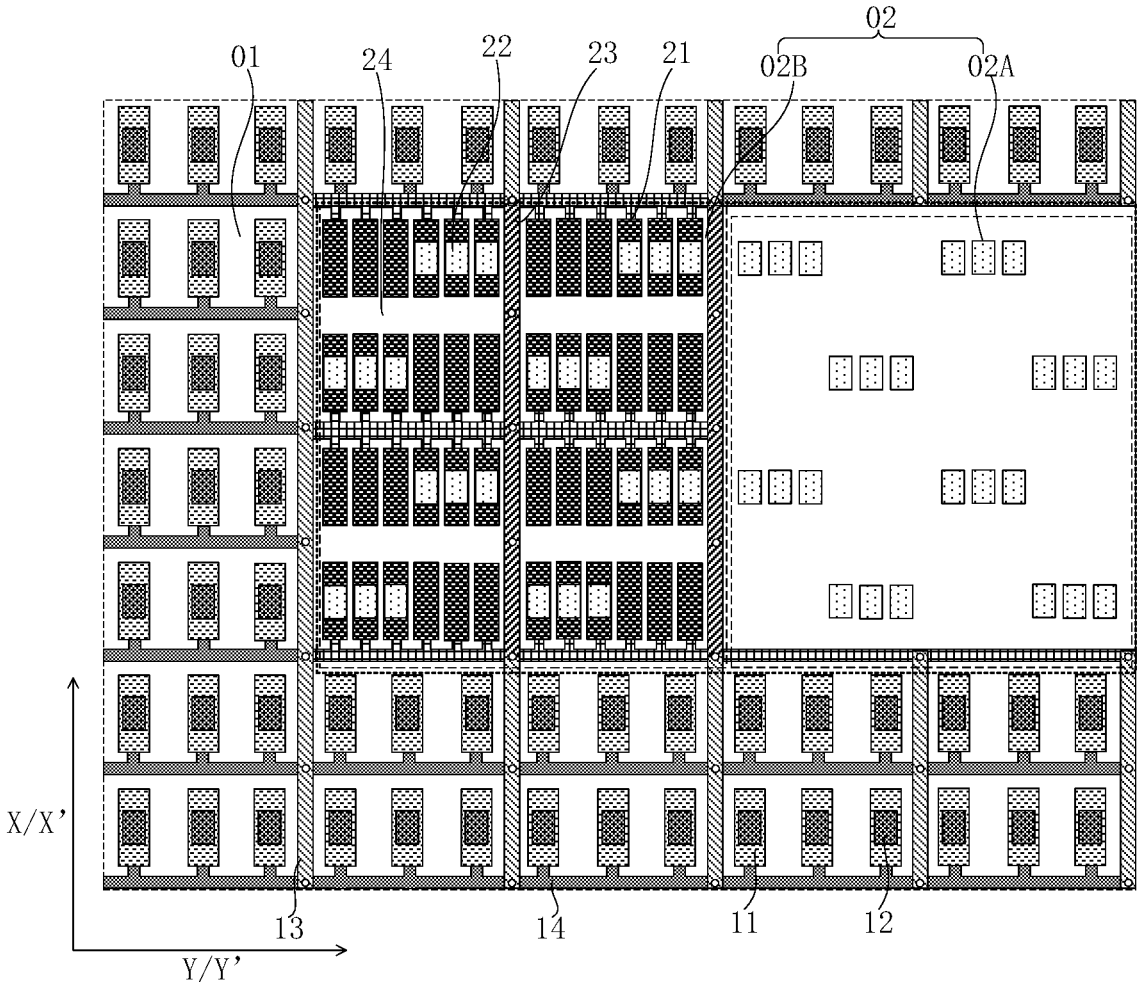
FIG. 14 is a partial enlarged view of still yet another display panel according to an embodiment of the present disclosure.

FIG. 14 is a partial enlarged view of still yet another display panel according to an embodiment of the present disclosure.

In an embodiment, as shown in FIG. 3, FIG. 4, FIG. 6, FIG. 7, and FIG. 14, in a region defined by two adjacent first fixed potential lines 13 and two adjacent third fixed potential lines 14, the number of the first pixel circuits 11 is n1; in a region defined by two adjacent second fixed potential lines 23 and two adjacent fourth fixed potential lines 24, the number of the second pixel circuits 21 is n2; and n1 and n2 are each a positive integer greater than or equal to 2, and n2>n1. For example, as shown in FIG. 3, FIG. 4, FIG. 6, and FIGS. 7, n1=3, and n2=6. As shown in FIGS. 14, n1=3, and n2=12.

In an embodiment, as shown in FIG. 14, s1 third pixel circuit groups are provided between two adjacent third fixed potential lines 14, and the third pixel circuit group includes multiple first pixel circuits arranged along the fifth direction; s2 fourth pixel circuit groups are provided between two adjacent fourth fixed potential lines, and the fourth pixel circuit group includes multiple second pixel circuits arranged along the seventh direction; and s1 and s2 are each a positive integer greater than or equal to 1, and s2>s1.

In another embodiment, as shown in FIG. 3, FIG. 4, FIG. 6, and FIG. 7, s1 third pixel circuit groups are provided between two adjacent third fixed potential lines, and the third pixel circuit group includes multiple first pixel circuits arranged along the fifth direction; s2 fourth pixel circuit groups are provided between two adjacent fourth fixed potential lines, and the fourth pixel circuit group includes multiple second pixel circuits arranged along the seventh direction; and s1 and s2 are each a positive integer greater than or equal to 1, and s2=s1.

In an embodiment, s1=1.

In an embodiment of the present disclosure, the first fixed potential line 13 is electrically connected to an input terminal V1 of the first power voltage transistor T1, or is electrically connected to a cathode of the first light-emitting diode 12; and the second fixed potential line 23 is electrically connected to an input terminal V1' of the second power voltage transistor T1', or is electrically connected to a cathode of the second light-emitting diode 22. In other words, the first fixed potential line 13 provides a power voltage to the first power voltage transistor T1 or provides a power voltage to the first light-emitting diode 12, and the second fixed potential line 23 provides a power voltage to the second power voltage transistor T1' or provides a power voltage for the second light-emitting diode 22.

In an embodiment, the second fixed potential line 23 transmits a power voltage, and attenuation of the power voltage on the second fixed potential line 23 basically remains the same at different moments. Therefore, it is easy to compensate the supply voltage on the second fixed potential line 23. In another aspect, the second fixed potential line 23 can always maintain transmission of the fixed potential signal within a particular time period, without being frequently charged and discharged, thereby avoiding a problem of charging delay due to potential climbing during a charging process. In still another aspect, compared with reducing the width of the second fixed potential line 23, reducing the density of the second fixed potential lines 23 does not change resistance and parasitic capacitance of the second fixed potential line 23, and therefore has a relatively small impact on the display effect.

In an embodiment, the function display region 02 is arranged at a position away from an access terminal of the power voltage, that is, a distance between the function display region 02 and the access terminal of the power voltage is greater than a distance between the function display region 02 and a side of the conventional display region 01 away from the access terminal of the power voltage.

The power voltage enters the conventional display region 01 and the function display region 02 of the display panel from the access terminal of the power voltage. Along an extending direction of the first fixed potential line 13, a current of the first fixed potential line 13, in a unit length, close to the access terminal of the power voltage is greater than a current of the first fixed potential line 13, in a unit length, far away from the access terminal of the power voltage; and along an extending direction of the second fixed potential line 23, a current of the second fixed potential line 23, in a unit length, close to the access terminal of the power voltage is greater than a current of the second fixed potential line 23, in the unit length, far away from the access terminal of the power voltage. In other words, along the extending direction of the first fixed potential line 13, a voltage drop of the first fixed potential line 13 at a position thereof far away from the access terminal of the power voltage is less than a voltage drop of the first fixed potential line 13 at a position thereof close to the access terminal of the power voltage; and along the extending direction of each of the second fixed potential line 23, a voltage drop of the second fixed potential line 23 at a position thereof far away from the access terminal of the power voltage is less than a voltage drop of the second fixed potential line 23 at a position thereof close to the access terminal of the power voltage. Therefore, setting the function display region 02 to be relatively far away from the access terminal of the power voltage can reduce a voltage drop difference between the second fixed potential line in the function display region 02 and an adjacent first fixed potential line 13 in the conventional display region 01.

Similarly, if the access terminals of the supply voltage are located at two opposite sides of the display panel, the function display region 02 can be arranged at a middle position of the two opposite sides of the display panel.

In an embodiment, the function display region 02 is arranged at a side of the conventional display region 01 away from the access terminal of the power voltage. In this case, an edge of the function display region 02 away from the access terminal of the power voltage is also away from the conventional display region 01, that is, edges of the function display region 02 are not all adjacent to the conventional display region 01, thereby reducing a length of a risk region in which brightness can suddenly change in each of the conventional display region 01 and the function display region 02 that are adjacent to each other.

Figure 15:
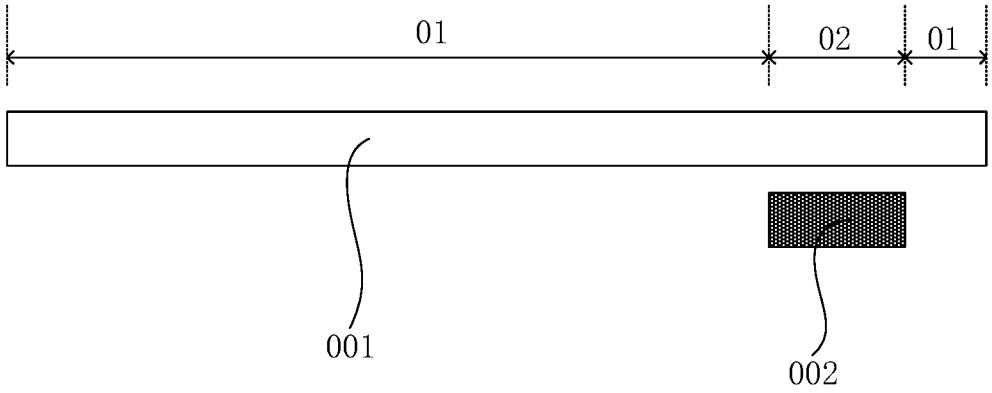
FIG. 15 is a schematic diagram of a display apparatus according to an embodiment of the present disclosure.

FIG. 15 is a schematic diagram of a display apparatus according to an embodiment of the present disclosure.

As shown in FIG. 15, the display apparatus includes the display panel 001 provided in any one of the foregoing embodiments. The display apparatus provided in an embodiment of the present disclosure can be a mobile phone. In another embodiment, the display apparatus provided can also be a computer, a television, or other display apparatuses.

As shown in FIG. 15, the display apparatus provided in an embodiment of the present disclosure further includes an optical function element 002, and the optical function element 002 is provided at a position of the display apparatus corresponding to the function display region 02 of the display panel 001. In other words, along a thickness direction of the display panel 001, the optical function element 002 is provided below the function display region 02 of the display panel 001. In this case, the optical function element 002 can emit light to a side of a light-emitting surface of the display panel 001 through the function display region 02, or can receive light from the side of the light-emitting surface of the display panel 001 through the function display region 02.

The optical function element 002 can be at least one of an optical fingerprint sensor, an iris recognition sensor, a camera, or a flashlight.

In the embodiment of the present disclosure, reducing the number of second fixed potential lines 23 in the function display region 02 can improve light transmittance of the function display region 02, thereby improving reliability of optical signal transmission of the function display region 02.

In the display apparatus provided in the embodiment of the present disclosure, reducing the number of second fixed potential lines 23 has a very small impact on a display effect of the function display region 02. In an embodiment, the second fixed potential line 23 transmits a fixed potential signal, and the attenuation of the fixed potential signal on the second fixed potential line 23 basically remains the same at different moments. Therefore, it is easy to compensate the fixed potential signal on the second fixed potential line 23. In another aspect, the second fixed potential line 23 can always maintain transmitting the fixed potential signal within a particular time period, without being frequently charged and discharged, thereby avoiding the problem of charging delay due to the potential climbing during a charging process. In still another aspect, compared with reducing the width of the second fixed potential line 23, reducing the density of second fixed potential lines 23 does not change the resistance and parasitic capacitance of the second fixed potential line 23, and therefore has a relatively small impact on the display effect.

The foregoing descriptions are some embodiments of the present disclosure and are not intended to limit this disclosure. Any modification, equivalent replacement, and improvement made within principle of the present disclosure shall fall within the protection scope of the present disclosure.

What is claimed is:

1. A display panel, the display panel having a conventional display region and a function display region where an optical function element is provided, and the display panel comprising:

first pixel circuits located in the conventional display region;

first fixed potential lines located in the conventional display region, wherein each of the first fixed potential lines extends along a first direction, and the first fixed potential lines are arranged along a second direction and electrically connected to the first pixel circuits;

second pixel circuits located in the function display region; and second fixed potential lines located in the function display region, wherein each of the second fixed potential lines extends along a third direction, and the second fixed potential lines are arranged along a fourth direction and are electrically connected to the second pixel circuits, wherein a distance between two adjacent first fixed potential lines of the first fixed potential lines is smaller than a distance between two adjacent second fixed potential lines of the second fixed potential lines.

2. The display panel according to claim 1, wherein m1 first pixel circuit groups are provided between the two adjacent first fixed potential lines of the first fixed potential lines, and each of the m1 first pixel circuit groups comprises at least two of the first pixel circuits arranged along the first direction; and m2 second pixel circuit groups are provided between the two adjacent second fixed potential lines of the second fixed potential lines, and each of the m2 second pixel circuit groups comprises at least two of the second pixel circuits arranged along the third direction, where m1 and m2 each are a positive integer greater than or equal to 1, and m2>m1.

3. The display panel according to claim 1, wherein the conventional display region at least partially surrounds the function display region, and light transmittance of at least part of the function display region is greater than light transmittance of the conventional display region.

4. The display panel according to claim 1, further comprising:

first light-emitting diodes located in the conventional display region, wherein each of the first pixel circuits is electrically connected to at least one of the first light-emitting diodes and comprises a first drive transistor and a first power voltage transistor, wherein the first power voltage transistor comprises an output terminal electrically connected to the first drive transistor; and second light-emitting diodes located in the function display region, wherein each of the second pixel circuits is electrically connected to at least one of the second light-emitting diodes and comprises a second drive transistor and a second power voltage transistor, wherein the second power voltage transistor comprises an output terminal electrically connected to the second drive transistor;

wherein one of the first fixed potential lines is electrically connected to an input terminal of the first power voltage transistor of one of the first pixel circuits or a cathode of one of the first light-emitting diodes, and one of the second fixed potential lines is electrically connected to an input terminal of the second power voltage transistor of one of the second pixel circuits or a cathode of one of the second light-emitting diode.

5. The display panel according to claim 4, further comprising:

third fixed potential lines located in the conventional display region, wherein each of the third fixed potential lines extends along a fifth direction and is electrically connected to at least two of the first fixed potential lines, and the third fixed potential lines are arranged along a sixth direction; and fourth fixed potential lines located in the function display region, wherein each of the fourth fixed potential lines extends along a seventh direction and is electrically connected to at least two of the second fixed potential lines, and the fourth fixed potential lines are arranged along an eighth direction.

6. The display panel according to claim 5, wherein each of the first fixed potential lines and each of the second fixed potential lines each are a metal conductive structure, and each of the third fixed potential lines and the fourth fixed potential lines is located in a different layer from each of the first fixed potential lines and the second fixed potential lines.

7. The display panel according to claim 5, wherein n1 first pixel circuits of the first pixel circuits are provided in a region that is defined by two adjacent first fixed potential lines of the first fixed potential lines and two adjacent third fixed potential lines of the third fixed potential lines; n2 second pixel circuits of the second pixel circuits are provided in a region that is defined by two adjacent second fixed potential lines of the second fixed potential lines and two adjacent fourth fixed potential lines of the fourth fixed potential lines; and n1 and n2 each are a positive integer greater than or equal to 2, and n2>n1.

8. The display panel according to claim 7, wherein s1 third pixel circuit groups are provided between two adjacent third fixed potential lines of the third fixed potential lines, and each of the s1 third pixel circuit groups comprises at least two of the first pixel circuits arranged along the fifth direction; s2 fourth pixel circuit groups are provided between two adjacent fourth fixed potential lines of the fourth fixed potential lines, and each of the s2 fourth pixel circuit groups comprises at least two of the second pixel circuits arranged along the seventh direction; and s1 and s2 each are a positive integer greater than or equal to 1, and s2>s1.

9. The display panel according to claim 8, wherein s1=1.

10. The display panel according to claim 7, wherein the s1 third pixel circuit groups are provided between two adjacent third fixed potential lines of the third fixed potential lines, and each of the s1 third pixel circuit groups comprises at least two of the first pixel circuits arranged along the fifth direction; s2 fourth pixel circuit groups are provided between two adjacent fourth fixed potential lines of the fourth fixed potential lines, and each of the s2 fourth pixel circuit groups comprises at least two of the second pixel circuits arranged along the seventh direction; and s1 and s2 each are a positive integer greater than or equal to 1, and s2=s1.

11. The display panel according to claim 1, wherein a density of the first pixel circuits in the conventional display region is greater than a density of the second pixel circuits in the function display region;

wherein pixel circuit clusters are formed in the function display region, each of the pixel circuit clusters comprises at least two second pixel circuits of the second pixel circuits, and a distance between adjacent second pixel circuits of the at least two second pixel circuits in one of the pixel circuit clusters is smaller than a distance between adjacent pixel circuit clusters of the pixel circuit clusters; and wherein at least two of the at least two second pixel circuits in one of the pixel circuit clusters are electrically connected to one of the second fixed potential lines.

12. The display panel according to claim 11, wherein at least one of the second fixed potential lines corresponds to one first fixed potential line of the first fixed potential lines along the second direction and is connected to the one first fixed potential line; and at least one of the second fixed potential lines extends to the function display region and is not directly connected to the one first fixed potential line.

13. The display panel according to claim 11, wherein at least one of the second fixed potential lines is staggered with each of the first fixed potential lines in the second direction.

14. The display panel according to claim 11, wherein adjacent pixel circuit clusters of the pixel circuit clusters are located at different sides of a light-transmitting region along the first direction, and adjacent pixel circuit clusters of the pixel circuit clusters are located at different sides of a light-transmitting region along the second direction.

15. The display panel according to claim 1, wherein the second fixed potential lines do not overlap with a transparent display region in a thickness direction of the display panel.

16. The display panel according to claim 1, wherein the first direction is parallel to the third direction, the second direction is parallel to the fourth direction, and the first direction is perpendicular to the second direction.

17. The display panel according to claim 1, further comprising:

first light-emitting diodes located in the conventional display region, wherein each of the first pixel circuits is electrically connected to at least one of the first light-emitting diodes and comprises a first drive transistor and at least one first reset transistor; and second light-emitting diodes located in the function display region, wherein each of the second pixel circuits is electrically connected to at least one of the second light-emitting diodes and comprises a second drive transistor and at least one second reset transistor, wherein at least one of a control terminal of the first drive transistor or an anode of each of the first light-emitting diodes is electrically connected to an output terminal of one of the at least one first reset transistor, and an input terminal of each of the at least one first reset transistor is electrically connected to one of the first fixed potential lines; and wherein at least one of a control terminal of the second drive transistor or an anode of each of the second light-emitting diodes is electrically connected to an output terminal of one of the at least one second reset transistor, and an input terminal of each of the at least one second reset transistor is electrically connected to one of the second fixed potential lines.

18. A display apparatus, comprising:

a display panel; and an optical function element, wherein the display panel has a conventional display region and a function display region where the optical function element is provided; the display panel comprises first pixel circuits located in the conventional display region, first fixed potential lines located in the conventional display region, second pixel circuits located in the function display region, and second fixed potential lines located in the function display region, wherein each of the first fixed potential lines extends along a first direction, and the first fixed potential lines are arranged along a second direction and electrically connected to the first pixel circuits; each of the second fixed potential lines extends along a third direction, and the second fixed potential lines are arranged along a fourth direction and are electrically connected to the second pixel circuits; and wherein a distance between two adjacent first fixed potential lines of the first fixed potential lines is smaller than a distance between two adjacent second fixed potential lines of the second fixed potential lines.

19. The display apparatus according to claim 18, wherein the optical function element is at least one of an optical fingerprint sensor, an iris recognition sensor, a camera, or a flashlight.

* * * * *